US008555910B2

(12) United States Patent
Webster et al.

(10) Patent No.: US 8,555,910 B2
(45) Date of Patent: Oct. 15, 2013

(54) SHELTER STRUCTURES, SUPPORT SYSTEMS THEREFOR, KITS, ACCESSORIES AND METHODS FOR ASSEMBLING SUCH STRUCTURES

(75) Inventors: Richard Webster, Shoreline, WA (US); Ann W. Speckman, Seattle, WA (US)

(73) Assignee: Nomadic Comfort LLC, Shorline, WA (US)

( * ) Notice: Subject to any disclaimer, the term of this patent is extended or adjusted under 35 U.S.C. 154(b) by 2 days.

(21) Appl. No.: 13/536,979

(22) Filed: Jun. 28, 2012

(65) Prior Publication Data

US 2013/0061898 A1 Mar. 14, 2013

Related U.S. Application Data

(60) Provisional application No. 61/533,732, filed on Sep. 12, 2011.

(51) Int. Cl.
*E04H 15/42* (2006.01)
*E04H 15/24* (2006.01)
*E04H 15/26* (2006.01)

(52) U.S. Cl.
USPC ..... 135/156; 135/99; 135/100

(58) Field of Classification Search
USPC ..... 135/99, 100, 156, 114, 115, 120.1, 117
See application file for complete search history.

(56) References Cited

U.S. PATENT DOCUMENTS

| | | | | |
|---|---|---|---|---|
| 214,996 A | | 5/1879 | Doane | |
| 1,409,316 A | | 3/1922 | Smith | |
| 1,581,330 A | | 4/1926 | Shaw | |
| 2,000,644 A | | 5/1935 | Powers | |
| 2,084,778 A | | 6/1937 | Powers | |
| 2,167,219 A | | 7/1939 | Sankey | |
| 3,063,521 A | | 11/1962 | Fuller | |
| 3,169,611 A | | 2/1965 | Snelson | |
| 3,182,672 A | * | 5/1965 | Biller, Jr. | 135/117 |
| 3,285,257 A | * | 11/1966 | Tombari et al. | 135/148 |
| 3,406,698 A | | 10/1968 | Hutchison | |
| 3,945,106 A | | 3/1976 | Mayr et al. | |
| 3,990,463 A | | 11/1976 | Norman | |

(Continued)

OTHER PUBLICATIONS

Verschonerungsverein der Stadt Stuttgart, "Lookout Tower Killesberg," Luz, Hans and Partner, Landschaftsarchitekten, Stuttgart (2001).

(Continued)

*Primary Examiner* — David Dunn
*Assistant Examiner* — Danielle Jackson
(74) *Attorney, Agent, or Firm* — Ann W. Speckman; Speckman Law Group PLLC

(57) ABSTRACT

Shelter structures having an upper shelter portion supported (internally or externally) at an apex and one or more peripheral support elements supported by an external suspension web provided externally of a base region of the upper shelter portion are provided. The upper shelter portion provides a roof-like structure, while a lower enclosure portion may be connected, directly or indirectly, to the upper shelter portion and may provide wall-like structures that may include doors, vents, windows, and the like, or that may comprise an open network of lines, straps, wires, or bands. In tent embodiments, the upper shelter portion and the lower enclosure portion may be provided as fabric structures that, when erected, form tensioned fabric structures. Support systems, kits for assembling structures, reinforcement features and methods for assembling structures are also disclosed.

30 Claims, 27 Drawing Sheets

(56) References Cited

U.S. PATENT DOCUMENTS

| | | | | |
|---|---|---|---|---|
| 4,473,976 | A | 10/1984 | Kuznetsov et al. | |
| 4,569,362 | A | 2/1986 | Fidler, Jr. | |
| 5,036,874 | A | 8/1991 | Lynch | |
| 5,163,461 | A | 11/1992 | Ivanovich et al. | |
| 5,524,570 | A | 6/1996 | Kaye | |
| 1,601,889 | A | 10/1996 | Silverstein | |
| 5,642,590 | A | 7/1997 | Skelton | |
| 5,642,750 | A | 7/1997 | Brown et al. | |
| 5,901,727 | A | 5/1999 | Kramer et al. | |
| 6,145,527 | A | 11/2000 | Gillis | |
| 6,220,264 | B1 | 4/2001 | Newman | |
| 6,415,806 | B1 | 7/2002 | Gillis | |
| 6,470,901 | B1 | 10/2002 | Scherer | |
| 6,615,552 | B2 | 9/2003 | Gillis | |
| 6,843,261 | B2 | 1/2005 | Gillis | |
| 6,866,055 | B2 | 3/2005 | Scherer | |
| 6,868,640 | B2 | 3/2005 | Barber | |
| 6,877,521 | B2 | 4/2005 | Webster et al. | |
| 6,892,742 | B2 | 5/2005 | Wang | |
| 6,901,714 | B2 | 6/2005 | Liapi | |
| 7,004,183 | B2 | 2/2006 | Gillis | |
| 7,013,608 | B2 | 3/2006 | Newland | |
| 7,137,399 | B1 | 11/2006 | Ransom et al. | |
| 7,575,010 | B2 | 8/2009 | Rottmann | |
| 7,578,306 | B2 | 8/2009 | Mettavant | |
| 7,578,307 | B2 | 8/2009 | Ung et al. | |
| 7,607,445 | B2 * | 10/2009 | von Dewitz et al. | 135/114 |
| 7,766,023 | B2 | 8/2010 | Scherer | |
| 7,987,864 | B1 | 8/2011 | Jackson | |
| 7,997,292 | B2 | 8/2011 | Scherer | |
| 8,001,987 | B2 | 8/2011 | Williams | |
| 8,220,475 | B2 * | 7/2012 | Yul et al. | 135/96 |
| 2004/0168715 | A1 * | 9/2004 | Wang | 135/124 |
| 2005/0150534 | A1 * | 7/2005 | Scherer | 135/156 |
| 2007/0240747 | A1 * | 10/2007 | Scherer | 135/131 |
| 2009/0145471 | A1 | 6/2009 | Chesness | |
| 2010/0065095 | A1 * | 3/2010 | Yul et al. | 135/121 |
| 2012/0017955 | A1 | 1/2012 | Zemitis | |

OTHER PUBLICATIONS

Kelty, "Hula House 6," Product Description, http://www.kelty.com/p-506-hula-house-6.aspc (Dec. 2011).

Marmot, "Halo 6P," Product Description, http://www.marmot.com/products/halo_6p (Dec. 2011).

Mountain Hard Wear "Innovation-Evolution Tension Arch," Product Description, http://www.mountainhardwear.com/Evolution-Tension-Arch (Dec. 2011).

Tentsmiths, "Authentic Period Tentage," Product Description, http://www.tentsmiths.com (Dec. 2011).

Hassler, "Great Theodolite housed in a tent. NOAA Central Library", Allen, David Yehling, "Scientific Mapping in New York before 1860" http://www.dyasites.com/maps/nysbook/Chapter10b.htm, Chapter 10, p. 7, Figure 10.2. (Oct. 2011).

Declaration of Richard Webster with attached Exhibit A, US Patent Application for "Shelter Structures, Support Systems Therefor, Kits, Accessories and Methods for Assembling Such Structures," (Jun. 28, 2012).

* cited by examiner

SHELTER STRUCTURES, SUPPORT SYSTEMS THEREFOR, KITS, ACCESSORIES AND METHODS FOR ASSEMBLING SUCH STRUCTURES

REFERENCE TO PRIORITY APPLICATION

This application claims priority to U.S. Patent Application No. 61/533,732 filed Sep. 12, 2011, which is incorporated herein by reference in its entirety.

TECHNICAL FIELD OF THE INVENTION

The present invention relates to shelter structures such as tents, exhibition structures, aviaries, greenhouses, shade structures, gazebos, pavilions, humanitarian relief structures, transient housing structures and the like, as well as to kits, components of, accessories for, and methods for assembling such structures.

BACKGROUND OF THE INVENTION

Early man created shelter using materials at hand: mud, stones, snow, ice, skins, sticks, foliage, bones, etc. Nomadic people either carry their shelter with them or build new shelter every time they move. For those nomads who choose to carry their shelter with them, it is a goal to make their weather-resilient shelters as light and compact as possible while still allowing for great internal volume.

There are two major portable shelter traditions. The earliest tradition uses structural material, such as wood, to create a relatively rigid framework. A canopy, perhaps of animal skins or felt or foliage, is then draped over or hung from this framework to seal out the weather. Teepees and yurts fit into this category. The invention of woven fabric revolutionized nomadic shelters, allowing for the canopy to be much lighter and more portable. Woven fabric also led to the rise of a new portable shelter tradition when the nomadic people of North Africa invented Black Tents. Black tents are tensioned fabric structures in which central poles were held in place under a ceiling of pre-stressed fabric, relying on the canopy itself for structural support. Another example of the early use of tensioned fabric to create a structure is seen in medieval military campaign tents, which used a single central mast from which a conically shaped canopy was stretched and anchored to ground, often with multiple guy lines added to increase internal volume and stability. Circus tents are another example of this type of central mast supported tent.

The invention of metal did little to further the refinement of these two shelter types—the self-supporting rigid framework tents and the tensioned fabric structures—until modern times when the development of light-weight tubular metal and the invention of composites such as fiberglass and carbon fiber led to further improvements in framing materials. Strong, collapsible framing materials led to the invention of dome tents, which follow the self-supporting framework tradition and tunnel tents, which follow the tensioned fabric tradition.

In recent times, the development of strong fabric composites has ushered in the age of large, non-portable tensioned fabric architectural structures, along with associated methods and techniques that are used to maintain these structures in equilibrium. To date there has been little use of the principles applied in this school of architecture in light-weight shelter design.

Another relatively recent development has been the invention of tensegrity structures, in which free-floating compression elements are suspended in a web of tension elements. In current practice, these structures are more artistic than practical.

Many different types of tent and canopy structures have been developed and are in use, ranging from highly portable, lightweight backpacking shelters to more commodious, heavier tent structures of various sizes, to larger structures having permanent or semi-permanent rigid supports. Various types of tent and canopy structures are disclosed, for example, in U.S. Pat. Nos. 214,996, 1,409,316, 1,581,311, 1,601,889, 2,000,644, 2,084,778, 2,167,219, 3,063,521, 3,169,611, 3,406,698, 3,990,463, 3,945,106, 4,473,976, 4,569,362, 5,036,874, 5,163,461, 5,642,590, 5,642,750, 5,901,727, 6,145,527, 6,220,264, 6,415,806, 6,470,901, 6,615,552, 6,843,261, 6,866,055, 6,868,640, 6,892,742, 6,901,714, 7,004,183, 7,013,608, 7,137,399, 7,575,010, 7,578,306, 7,578,307, 7,766,023, 7,987,864, 7,997,292, 8,001,987, U.S. Patent Publication 2009/0145471 A1 and U.S. Patent Publication 2012/0017955 A1.

Many tent structures, such as dome and tunnel styles of tent structures, are shaped using multiple poles (serving as compression elements) that extend along paths between two support locations on the ground or between support locations positioned at or near other poles. In dome style tents, the paths of these types of support poles often cross or intersect one another and, in combination, they may form a freestanding framework structure. In tunnel style tents, these types of support poles generally run parallel to one another and are maintained in place by their association with or connection to fabric portions of the tent. Neither dome nor tunnel style tents typically employ support poles forming closed or continuous compression elements.

U.S. Pat. No. 6,877,521 discloses a tent wherein a sidewall portion is joined to a generally conical roof section at a defined transition. A relatively narrow fabric tension shelf is provided internally of the transition for retaining a semi-flexible compression hoop. An internal center pole is provided and the pole, tension shelf, compression hoop and fabric act together as an engineered unit to provide a stable structure without the need for an extensive external or internal pole system and without the need for a multiplicity of individual ties for the hoop.

Notwithstanding the considerable efforts directed to developing shelter structures, the existing structures remain far from ideal. Applicant's disclosure is directed to providing shelter structures that may be assembled and disassembled easily and transported conveniently, that provide substantial internal volume, and that may be used in a variety of applications. The shelter structures disclosed herein improve upon existing collapsible tent structures, as well as exhibition structures, aviaries, greenhouses, shade structures, gazebos, pavilions, humanitarian relief structures, transient housing structures and the like.

SUMMARY

Tensioned structures, including tensioned fabric structures, that apply both the newer and the historical traditions in a novel way are disclosed. While mimicking traditional shelter shapes, these structures may exploit the properties of strong, light-weight fabrics and framing materials, and use principles gleaned from the study of architectural tensioned fabric structures. In one embodiment, tensioned structures of the present invention incorporate an external suspension web mounted to or forming a part of the structure and extending externally of the structure at a transition region located at the junction of an upper canopy portion and a lower enclosure portion. In another embodiment, tensioned structures of the present invention incorporate an external suspension web extending externally of the structure in proximity to a base portion of a structure, and/or at an intermediate region of the structure above a base region. The external suspension web typically has a substantially continuous inner edge mounted or attached to the fabric structure, with the web structure extending externally of the fabric structure.

In some embodiments, the external suspension web incorporates or is associated with one or more structures for suspending a structural element, such as a peripheral support element in the form of a hoop or a partial hoop, externally of the structure. In some embodiments, the external suspension web incorporates or is associated with one or more fixtures for supporting anchoring structures, such as guy lines, cables, or the like that, when the structure is erected, may be anchored to the ground or other supports to anchor the structure and evenly distribute tensile forces. The external suspension web may thus serve to suspend a structural element such as a peripheral hoop or partial hoop, and/or to be suspended by anchoring structures. In these embodiments, the combination of the external suspension web and a peripheral hoop or partial hoop, with or without anchoring structures, functions to distribute forces substantially uniformly and symmetrically along a perimeter of the structure and improves the tautness of the structure, thereby providing a more stable, more durable and less leak-prone structure. This arrangement also allows for greater internal volume using fewer structural framing support elements than are required for conventional collapsible structures.

In one embodiment, structures of the present invention employ at least one external suspension web for retaining a closed compression element such as a ring-shaped element that, when the structure is erected, is suspended externally of tensioned fabric near the base of an upper tensioned canopy portion to define internal space and to create large internal volumes using minimal framing materials. The suspension of a closed compression element, such as a ring-shaped hoop, near the base of an upper tensioned canopy structure directs multidirectional tension forces onto a plane defined by the closed compression element, which are easily resisted by the closed compression element. In alternative embodiments, a partially ring-shaped element or hoop may be suspended externally of the structure as a compression element near the base of an upper tensioned canopy portion. These tensioned structures employing one or more external suspension webs supporting an externally suspended peripheral compression element require less structural framing material and considerably fewer framing elements than those required for other shelter structures, such as tunnel-like structures and dome structures, which allows for greater portability and simpler set-up, and often provides more usable internal volume as well.

In one aspect, shelter structures of the present invention are formed as tensegrity structures composed of isolated (non-intersecting and non-contacting) compression members supported in a pre-stressed field of continuous tension that delineates the system spatially. An external peripheral support element in the form of a closed or partially open element serves as an isolated compression element and is typically located at lower peripheral region of an upper canopy portion, or at a transition region between an upper canopy portion and a lower enclosure or framework portion. In this embodiment, a pre-stressed field of continuous tension is provided by the upper tensioned canopy portion alone or in combination with a lower enclosure or framework portion. An apical support element may be provided as an open compression member supported by the ground or by a base structure at one end and by a pre-stressed, tensioned upper canopy portion at an opposite end, or as an overhead support element.

In one aspect, shelter structures of the present invention comprise an upper shelter portion (or canopy-like structure) that, when the structure is erected, is supported (internally or externally) at an apex and peripherally by means of one or more peripheral support element(s) serving as a closed or partially open compression element. The peripheral support element is mounted externally of the shelter structure in an externally-directed suspension web. The upper shelter portion, or canopy, may provide a roof-like structure and, when erected, may be supported at its apex internally by an apical support element such as a rigid pole and/or externally by an overhead support element. A lower shelter portion may be connected, directly or indirectly, to the upper shelter portion to provide a completely or partially enclosed internal volume defined by wall panels, doors, vents, windows, and the like.

Both the upper and lower shelter portions may be constructed wholly or partially from pliable materials such as fabrics and flexible sheet materials that, when supported as described herein, form tensioned structures. The term "fabric," as used herein, refers to any pliable material, including traditional fabrics comprising woven or non-woven fibers or strands, as well as fiber reinforced sheet materials, and other types of flexible sheeting materials composed of natural and/or synthetic materials, including flexible plastic sheeting material, pliable thermoplastic, foam and composite materials, screen-like or mesh materials, and the like. Other types of rigid or semi-rigid materials may be used in panel structures of the present invention, including various types of plastic and thermoplastic sheet material, flexible and rigid foam materials, as well as thin wood-based and composite sheet materials. Materials forming the upper and/or lower shelter portions may be treated or impregnated with various types of compositions and coatings to provide desired properties, including water resistance, fire resistance, breathability, wear resistance and the like, and fabric composites comprising multiple layers of constituent materials may be used. Shelter structures described herein are suitable for use as portable tent shelters, portable, semi-permanent and/or permanent protected shelters for work and recreation, transient housing structures, exhibition structures, special purpose enclosures, and the like.

An apical support element supports an apex of the upper shelter portion either internally or externally of the structure. When an internal apical support element is used, it generally comprises, or can be assembled to provide, one or more substantially rigid support member(s). In some embodiments, an internal central apical element is provided as a generally linear, axial support element extending between the apex of the upper shelter portion and a ground support surface in a generally axial manner. In alternative embodiments, an internal apical support element may comprise a plurality of substantially rigid support elements arranged, in combination, to support the apex of the upper shelter portion. In some embodiments, one or more internal apical support element(s) may comprise telescoping or collapsible members, such as telescoping poles, interconnecting tubular members, shock-corded tubular members and other arrangements of smaller units that, when assembled and fit together, form a generally rigid apical support structure. In some embodiments, internal apical support element(s) are adjustable to provide support members having different, selectable lengths. In tent embodiments, an apical support element may comprise one or more staff(s) or hiking pole(s).

An external apical support element may be provided to support an apex of the upper shelter portion as a substitute for, or to supplement, one or more internal apical support element(s). External apical support elements may be provided by overhanging tree limbs or beams or other types of overhanging structures to which an apex of the upper shelter portion may be attached. In another embodiment, the apex of the upper canopy or shelter portion may be supported by (e.g., by attachment to) an external cable mounted to one or more supports to provide a generally taut overhead support. Other types of external support elements may also be provided, as described below.

In one embodiment, a peripheral support element, when assembled, has a substantially continuous perimeter and a substantially closed structure form. The peripheral support element may be provided as a plurality of smaller sub-units, such as interconnecting tubular members that can be assembled to provide continuous perimeter forms. Once assembled, the peripheral support element has, or can be manipulated to form, a predetermined configuration, such as a circular configuration. When assembled, the peripheral support element of this embodiment provides a substantially continuous peripheral form defining a plane. In another embodiment, a peripheral support element forms a partially open element extending around at least 50% of the perimeter of the underlying structure at the location of the peripheral support element. The portion of the perimeter not supported by the peripheral support element may be open, or it may be closed by means of a stabilizing strut having a linear or curved or polygonal configuration, arranged on the same plane as the plane formed by the partial peripheral support element, or on a different plane.

While substantially hoop-like, circular peripheral support elements are preferred for many applications, peripheral support element(s) having a variety of other perimeter configurations, including oval, elliptical, polygonal, and the like, may be suitable for various applications. The perimeter configuration of the peripheral support element(s) generally matches the peripheral configuration of the base of the upper shelter portion. In many embodiments, the peripheral support element is provided as a generally circular, hoop-like structure; in many embodiments the peripheral support element is constructed from multiple tubular members attachable to or interlockable with one another to form a linear rod that bends sufficiently along its axis to form a generally rigid, hoop-like, continuous support element when the ends are joined. Shock-corded tubular sections or other types of sections that fit together to provide a continuous linear and/or closed structure may be used.

The upper shelter portion may be constructed from a continuous sheet or from multiple joined panels of pliable fabric material, and/or from relatively lightweight rigid or semi-rigid elements, such as panels, that are connected to or connectible to one another and that, when supported at an apex, form a downwardly extending geometric shape providing an internal volume. In many embodiments, the upper shelter portion is provided as a generally cone-shaped structure having a central apex and a circular base portion. In alternative embodiments, the upper shelter portion may have an oval- or elliptical-shaped base portion, or it may have a polygonal-shaped base portion, such as rectangular, square, pentagonal, hexagonal, octagonal, etc. In some embodiments, depending on the configuration, size, material and other factors, the upper shelter portion may have multiple apical portions, or it may have an apex formed in the configuration of a line or a geometrical shape, rather than as a point. In some embodiments, the apex is at a central point of the upper shelter portion, while in other embodiments, the apex may not be at a center point of the upper shelter portion, and either or both the upper shelter portion and/or the lower enclosure portion may be asymmetrically arranged with respect to the apex of the structure.

A lower enclosure portion or framework structure may be connected or connectible, directly or indirectly, to an upper shelter portion at a transition region to provide sidewalls that, together with the upper shelter portion, provide a partially or fully enclosed internal space. In some embodiments, the upper shelter and lower enclosure portions may interface directly with one another at a transition region provided as a seam or another type of substantially continuous attachment. In some embodiments, the upper shelter and lower enclosure portions may interface directly or indirectly with one another and/or with an additional element, such as a band or web, or another element that provides enhanced strength, durability, and/or stability at the transition region.

The lower enclosure portion may be constructed from a continuous sheet of pliable material, or it may be constructed from a plurality of pliable panels attached or attachable to one another by sewing, bonding, sealing, or the like. Alternatively, the lower enclosure portion may be formed from relatively lightweight rigid or semi-rigid elements that are connected or connectible to one another. An upper region of the lower enclosure portion typically has the same general cross-sectional configuration as the base region of the upper shelter portion or another element provided at the transition region. In tent-like structures, the lower enclosure portion is constructed from a pliable fabric that may be sewn or bonded or otherwise connected (directly or indirectly), at a transition region, to the upper shelter portion. The upper region of the lower enclosure portion may be attached to the base region of the upper shelter portion directly or indirectly when a band or web or another element is provided at the transition region.

In tensioned fabric structures employing an externally directed suspension web at a transition region, the suspension web is attached or connected to, or otherwise associated with, a perimeter region of the upper shelter portion or lower enclosure portion, or to a transition element provided at the interface of the upper shelter and a lower enclosure portions, and extends externally of the upper shelter portion (i.e., away from a central region and apex of the fabric structure). When the structure is assembled with an apical support element supporting the apex of an upper shelter portion and a peripheral support element mounted in the externally directed suspension web at the transition region, the peripheral support element provides compressive resistance to the tensile forces exerted on it at the base region of the upper shelter or the transition region, and substantially all of the local forces are transferred through the external suspension web to the peripheral support element. The peripheral support element is thus a compressive element that is suspended in and by the pre-stressed tension elements, including the upper and lower shelter portions and the external suspension web. Together, this balance of elements and the forces they exert provides a stable tensioned structure. When the internal edge of the externally directed suspension web has a generally round configuration and the peripheral support element is a generally continuous circular hoop-like structure, the forces are exerted in a substantially uniform and/or symmetrical manner, and a very stable structure is provided. Support and/or reinforcement structures may be provided internally or externally of the fabric structure in connection with suspension webs provided at a transition region.

Multiple peripheral support elements having the same or different perimeter dimensions may be provided and may be mounted to the same or to a co-located external suspension web. Multiple peripheral support elements may be supported at multiple externally directed suspension webs at different locations along the structure—i.e., at different levels of the structure. In one embodiment, for example, a peripheral support element is retained in an external suspension web provided at a transition region between the upper shelter portion and a lower shelter portion of the structure, and another peripheral support element is retained in another external suspension web provided at a transition region between the lower shelter portion and a base portion of the structure, which may be associated with an integral floor.

In another aspect, shelter structures of the present invention having a peripheral support element suspended at a transition region between the upper shelter portion and a lower enclosure portion may additionally include a fabric eave or panel located generally below the transition region. The fabric eave or panel may have the same general configuration as the transition region and, when the transition region has a generally circular configuration, the fabric eave or panel may be provided as a generally cylindrical band, or as an annular band having a larger diameter peripheral edge and an opposite smaller diameter peripheral edge. A cylindrical fabric eave or band may be attached or mounted to the fabric structure at a location below the transition region and the suspension web located at the transition region, forming a generally cylindrical band below the suspension web when the fabric structure is erected. An annular fabric eave or ventilation band may be attached or mounted to the fabric structure at a location below the transition region and the suspension web, with the eave or band angled internally or externally with respect to the inner edge of the suspension web when the fabric structure is erected. The eave may be fabricated from a material having different structural and/or functional properties than the material forming the upper shelter portion and/or the lower enclosure portion. The eave may be provided as a structural element that assists in the distribution of forces exerted in the transition region, and it may additionally or alternatively provide ventilation between the interior of the shelter structure and the outside environment when it is constructed from an air permeable material and provided in a location that is protected from the elements by the overhanging external suspension web and/or base region of the upper shelter portion, or by a fly or another accessory element.

In yet another aspect, shelter structures of the present invention having a peripheral support element suspended at a transition region between the upper shelter portion and a lower enclosure portion may additionally include an internally directed tensioning structure suspended between the transition region of the fabric structure and a central internal region of the shelter, such as an internal central apical support element. In some embodiments, the internally directed suspension structure may be adjustably positioned in association with a central support structure, providing for adjustment of the position of the internal suspension structure along a portion of the length of an internal central apical support element. An internally directed tensioning structure may comprise, for example, a plurality of radially arranged webs or supports, or a substantially continuous fabric element.

A base portion of the lower enclosure portion is generally anchored to the ground or to a base support structure when the structure is erected to provide a pre-stressed structure that exerts tensile forces at the transition region between the lower enclosure portion and the upper shelter portion. The tensile forces are preferably substantially uniformly and/or symmetrically distributed around the periphery of the transition region. These tensile forces generally oppose compressive forces exerted by the apical support element and the peripheral support element, via the external suspension web provided at the transition region. In structures that don't incorporate a lower enclosure portion, various elements, such as suspension web(s), straps or lines or wires may be used to exert the desired tensile forces on the base of the upper shelter portion or at the transition region.

In some embodiments, an externally directed suspension web may be provided at a base portion of the lower enclosure portion. A substantially continuous inner edge of the base external support web is preferably mounted or bonded to, or otherwise associated with, the base region of the lower enclosure portion of the structure and extends externally of the base region. In one embodiment, an external suspension web may be provided at a base region of a shelter portion of a fabric structure and configured for retaining a peripheral support element, as described above with reference to shelter structures having an external suspension system provided at a transition region between an upper shelter portion and a lower enclosure portion. In another embodiment, an external suspension web may be provided at a base region of the fabric shelter structure, the external suspension web having an inner edge mounted or attached to, or otherwise associated with, the fabric structure and an outer edge of the external suspension web having fittings for attaching or supporting anchoring structures, such as guy lines, cables, stakes, or the like that, when the structure is erected, may be anchored to the ground or other supports to anchor the structure and evenly distribute tensile forces. In these embodiments, the use of a base external suspension web facilitates more uniform and/or symmetrical distribution of tensile forces at a base region of a structure.

According to yet another aspect, shelter structures of the present invention may comprise an external suspension web provided at an intermediate region of the structure, in a region above the base region of a shelter portion. A substantially continuous inner edge of the external support web in this embodiment is preferably mounted or bonded to, or otherwise associated with, an intermediate peripheral region of the structure, extending externally of the structure. In one embodiment, an intermediate external suspension web may be configured for retaining a peripheral support element, as described above with reference to shelter structures having an external suspension system provided at a transition region between an upper shelter portion and a lower shelter portion. In another embodiment, an intermediate external suspension web may provide fittings for attaching or supporting anchoring structures, such as guy lines, cables, or the like that, when the structure is erected, may be anchored to the ground or other support structures to anchor an intermediate region of the structure and evenly distribute tensile forces through the intermediate region. In these embodiments, the intermediate external suspension web facilitates more uniform and/or symmetrical distribution of tensile forces in an intermediate region of a structure.

Stabilizing webs and panels are disclosed for use with the fabric structures of the present invention. In some embodiments, the upper shelter portion and/or the lower shelter portion may be largely open, and one or both shelter portions may comprise an "open" network of structural ribs, tendons, webbing, lines, straps, wires, bands, buttresses or the like. These components may be used to assemble open structural frameworks and skeletal support structures suitable for supporting coverings or canopies of various types. This type of structural framework may be covered to provide a partially or completely enclosed internal space using various types of fabric coverings, coverings composed of natural and synthetic sheet materials, screening materials, and the like.

In some applications, fabric structures of the present invention may be designed for and used as portable and collapsible structures, such as tents, that may be erected, taken down and transported easily and conveniently. In other applications, structures of the present invention may be designed for and used as semi-permanent or permanent structures having a generally larger internal volume for applications such as temporary or semi-permanent housing structures, operational bases, exhibition spaces, aviaries, greenhouses, or the like. In yet other applications, structures of the present invention may be scaled and erected, permanently or temporarily, as larger architectural structures, exhibition structures, and the like.

Kits for erecting structures of the present invention generally comprise a structure having at least a shelter portion and an external peripheral suspension web provided at a peripheral portion of the base of the shelter portion for suspending one or more peripheral support element(s), and/or for supporting a plurality of anchoring structures. Structures of the present invention may comprise one or more peripheral suspension webs positioned at one or more of the following locations: at a base region of an upper shelter portion; at a transition region located at the interface of an upper shelter portion and a lower enclosure portion; at a base region of a structure; and/or at an intermediate region of a structure located above the base region. Additional kit components may include one or more peripheral support element(s), a lower enclosure portion, one or more internal or external apical support element(s), one or more additional external suspension webs or systems and peripheral support elements, a base or floor, a "fly" or another external covering, and anchoring elements such as straps, lines, wires, stakes, or the like.

BRIEF DESCRIPTION OF THE FIGURES

Illustrative embodiments of various aspects and elements of the present invention will be described in greater detail in the following detailed description with reference to the accompanying illustrations and images.

FIG. 1A shows a tent embodiment having a conical upper shelter portion supported by an internal central apical support pole and a continuous circular peripheral support element, with an access opening in the lower enclosure structure in a closed condition, and FIG. 1B shows a tent embodiment having a conical upper shelter portion supported by multiple internal apical support poles and a continuous circular peripheral support element, with an access opening in the lower enclosure structure in a closed condition. FIG. 1C shows a tent having a pyramidal upper shelter portion and a polygonal peripheral suspension web supporting a polygonal peripheral support element at a transition region between upper and lower enclosure structures.

FIG. 2A shows a cantilevered curved external support element; FIG. 2B shows a two-legged bipodal arrangement for supporting the apex; FIG. 2C shows a two-legged arrangement for suspending a cable over the apex; and FIG. 2D shows a three-legged tripodal arrangement for supporting the apex.

FIG. 3A shows an enlarged perspective view illustrating a section of the external peripheral suspension web and support element as illustrated in the fabric structures shown in FIGS. 1 and 2. FIG. 3B shows a perspective view illustrating a section of another embodiment of an external peripheral suspension web having a different configuration from that shown in FIG. 3A. FIG. 3C shows an alternative embodiment in which the external peripheral suspension web comprises a plurality of spaced tabs extending externally of the structure. FIG. 3D shows another alternative embodiment in which the external peripheral suspension web is provided as a sleeve extending externally of the structure. FIG. 3E shows another alternative embodiment in which the external peripheral suspension web comprises a band in combination with a pocket, both extending externally of the structure. FIG. 3F shows an alternative embodiment in which the external peripheral suspension web comprises multiple spaced sleeve or band elements.

FIG. 5A schematically illustrates external buttressing elements provided at the transition region for stabilizing an external suspension web, and FIG. 5B schematically illustrates internal buttressing elements provided at the transition region for stabilizing the transition region, with a section of the transition area broken away to illustrate the internal buttressing element.

FIG. 6A schematically illustrates an embodiment in which a fabric eave has an annular configuration and is positioned between an inner edge of the external suspension web and an upper edge of the lower shelter portion, providing an eave configuration that extends downwardly and inwardly from a portion of the suspension web or the transition region. FIG. 6B schematically illustrates an embodiment in which a fabric band having a generally cylindrical configuration is positioned between an inner edge of the external suspension web and an upper edge of the lower shelter portion, providing a downwardly directed band. FIG. 6C schematically illustrates a band having a generally cylindrical configuration and location as shown in FIG. 6B, wherein the band incorporates regions having different structural and/or functional properties, including air permeable ventilation regions. FIG. 6D schematically illustrates an embodiment in which a fabric band has an annular configuration and is configured as an extension of an upper portion of the lower enclosure portion of the fabric structure and extends downwardly and outwardly from a portion of the suspension web or the transition region.

FIG. 7A shows an internal tensioning element in the form of a liner mounted between an internal transition region and an internal support element in an downwardly angled orientation. FIG. 7B shows a liner similar to that shown in FIG. 7A mounted between an internal transition region and an internal support element in an upwardly angled orientation. FIG. 7C shows a canopy structure having an internal tensioning element in the form of a plurality of straps extending between an internally directed suspension web and an internal support element, with the tensioning element in a downwardly angled orientation.

FIG. 8A illustrates an embodiment having a single peripheral suspension web and a generally elliptical peripheral support element provided near a transition between the upper shelter portion and the lower enclosure portion. FIG. 8B illustrates an embodiment having multiple peripheral suspension webs and peripheral support elements provided near transition regions.

FIG. 10A shows a structure having a generally round base portion and an external suspension web having a generally round internal edge and a polygonal external edge extending externally of the base portion. FIG. 10B shows a fabric structure having an external suspension web positioned at a base portion as shown in FIG. 10A and having a differently configured external suspension web supporting a peripheral support element. FIG. 10C shows a structure having a generally polygonal base portion and an external suspension web comprising a plurality of tabs extending externally from a portion of the base of the fabric structure. FIG. 10D shows a structure having a generally round base portion for a portion of its perimeter and an external suspension web having a generally round internal edge extending partially around the base portion of the fabric structure. FIG. 10E shows a structure having external suspension webs extending along a portion of the perimeter of both a transition region and a base region of the structure, each supporting a peripheral support element extending around at least 50% of the perimeter of the structure.

FIG. 11A shows a conical tent structure incorporating an external web extending from a base region and having an integral and reinforced floor. FIG. 11B shows a conical tent structure incorporating an external web extending from a base region and suspending a peripheral ring, and additionally providing a central base support element. FIG. 11C shows a structure having an external suspension web extending externally from a portion of the base of the structure along a portion of its perimeter and having an alternative internal apical support structure. FIG. 11D shows a rectangular tent incorporating an external web extending from a base region; and FIG. 11E shows a rectangular tent incorporating an external web extending from a base region and suspending a rigid rectangular peripheral support element.

FIG. 14A shows one exemplary embodiment of a lower open network structure and a base external suspension web. FIG. 14B illustrates another exemplary embodiment of a lower open network structure. The apical support member is not shown for purposes of clarity.

FIG. 16A shows the external contours of the tent with the fly mounted over it and FIG. 16B shows the fabric structures below the fly.

DESCRIPTION

Figure 1A:
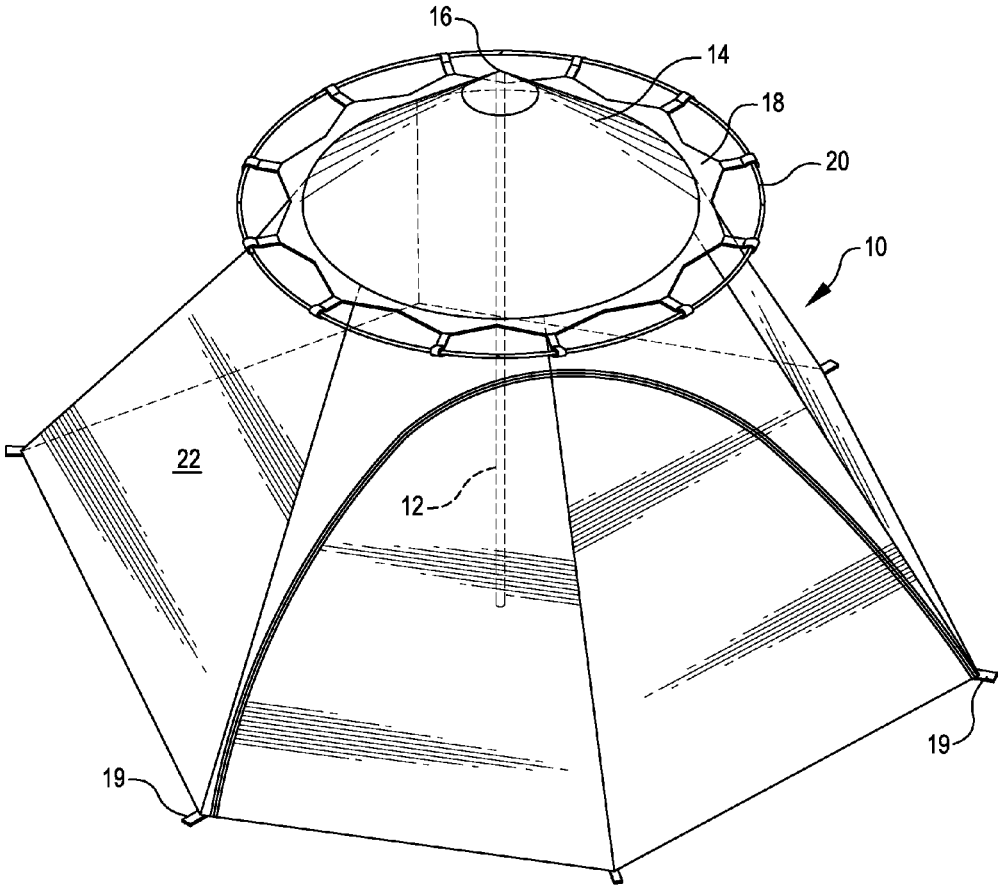
FIGS. 1A-1C are schematic drawings from an upper perspective view, showing the exterior of an assembled fabric structure in the form of a tent having an upper shelter portion and a lower enclosure structure, and having a peripheral suspension web suspending a continuous peripheral support element externally of the fabric structure at the transition region.
Figure 1B:
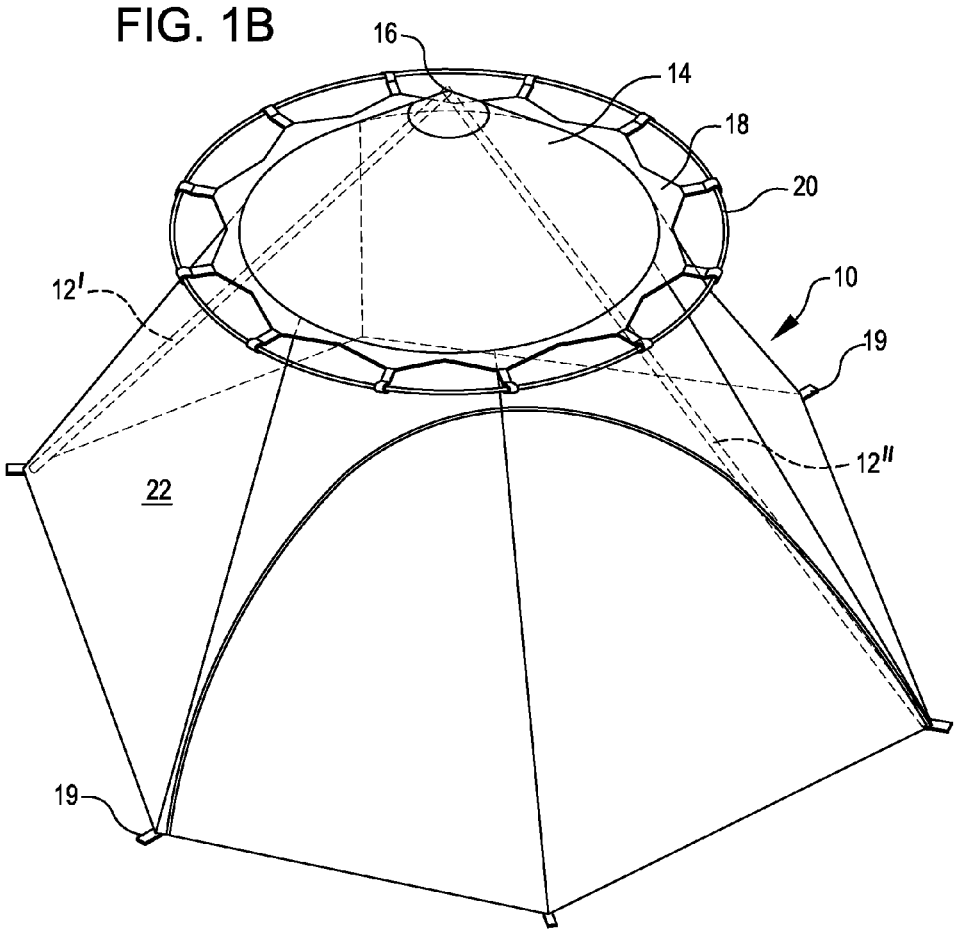

FIGS. 1A and 1B show the exterior and interior supporting structures (interior in dashed lines) of shelter structure 10 comprising one or more internal apical support element(s) 12 (12', 12") positioned, directly or indirectly, on the ground or on a stable support or platform when the structure is erected, an upper shelter portion 14 supported (directly or indirectly) at an apex 16 by one or more internal apical support element(s) 12 (12', 12"), an external suspension web 18 supporting a peripheral support element 20, and a lower enclosure portion 22 extending from and below the upper shelter portion. Doors, vents, windows, openings and other structures may be provided in the upper and/or lower enclosure portion(s), as is known in the art.

For lightweight, portable shelters suitable for use as tents or other types of portable and collapsible structures, the upper shelter portion 14 (e.g., a canopy-like structure) and lower enclosure portion 22 (e.g., sidewalls) may be constructed from continuous sheet materials, or by joining multiple panels of a pliable fabric or sheet material, with the upper shelter and lower enclosure portions being joined (directly or indirectly) at a transition region. The pliable fabric or sheet material may be stretchable, at least to some degree, or it may comprise a substantially non-stretchable material. In alternative embodiments, described in more detail later, the upper shelter portion and/or the lower enclosure portion may be constructed from semi-rigid or even substantially rigid, generally lightweight materials that form the desired configuration of the upper shelter and/or lower enclosure portion(s), or from panels or other sub-units that may be assembled to form the desired configuration of the upper shelter and/or lower enclosure portion(s).

In the embodiment shown in FIGS. 1A and 1B, upper shelter portion 14 has a generally conical configuration and forms a circular base region at an interface with external suspension web 18. Lower enclosure portion 22 comprises multiple panels joined to form the enclosure portion and has a generally circular upper region where it interfaces with external suspension web 18 and a generally polygonal base region. It will be appreciated that in alternative embodiments, the base region of lower enclosure portion 22 may have a generally circular rather than polygonal configuration, or it may have a partially circular and a partially polygonal configuration. The tent structure of FIG. 1A is supported at the apex 16 of upper shelter portion 14 by a single internal apical support element 12 positioned centrally, while the tent structure of FIG. 1B is supported at the apex 16 of upper shelter portion 14 by two internal central support elements 12', 12" positioned at angles to the support surface. Suitable reinforcement and fittings may be provided at apex 16 for interfacing with one or more end(s) of apical support element(s) 12, 12', 12".

Figure 1C:
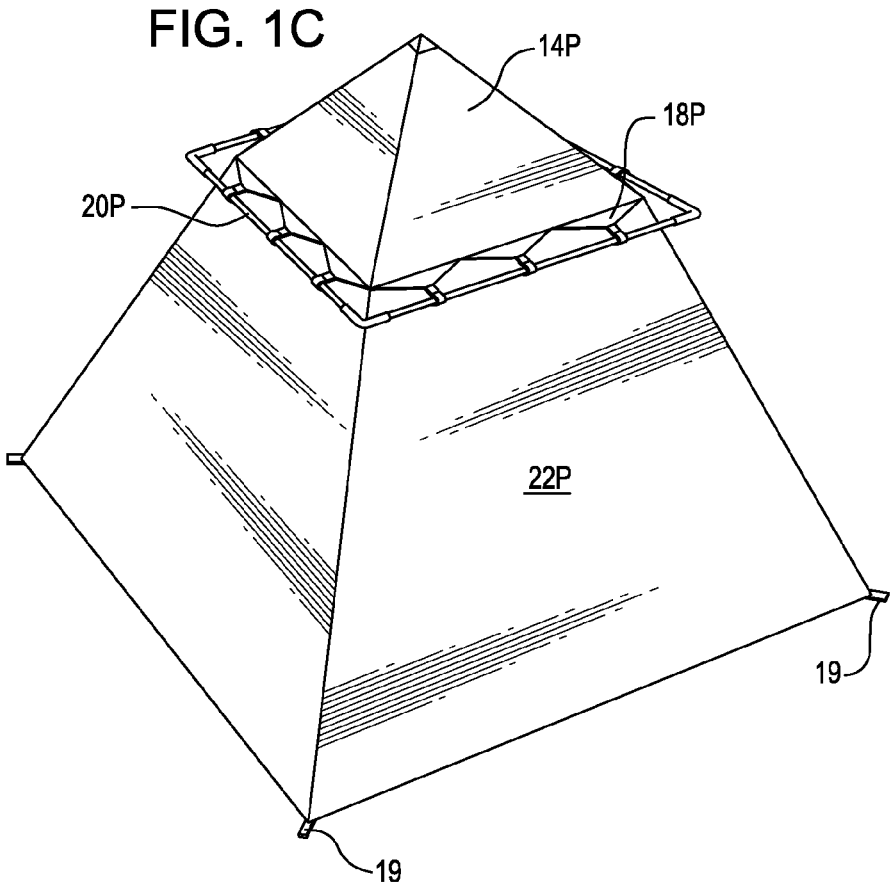

FIG. 1C schematically illustrates an embodiment in which upper shelter portion 14P is generally pyramidal and has a rectangular base region where it interfaces with a polygonal (e.g., square) external suspension web 18P. In the embodiments shown in FIGS. 1A-1C, the configuration of external suspension webs 18, 18P and peripheral support elements 20, 20P generally match the configuration of the base region of the upper shelter portion (e.g., circular in the embodiment of FIGS. 1A and 1B and square or rectangular in the embodiment of FIG. 1C). The external suspension web 18, 18P is mounted (directly or indirectly) in proximity to, and preferably at, a transition region between upper shelter portion 14, 14P and lower enclosure portion 22, 22P. In alternative embodiments, the configurations of the base region of the upper shelter portion and the peripheral support elements need not match. In one embodiment, for example, a base region of the upper shelter portion may be polygonal, e.g., having at least three sides, and an inner edge of an external suspension web is configured to match the polygonal configuration of the shelter portion base region, while the outer portion of the external suspension web is configured to capture and retain a curved or generally circular peripheral support element.

Pre-stressed fabric is suspended between opposing apical and base support termini and further spatially delineated by at least one peripheral support element suspended in at least one peripheral suspension web. Base regions of the lower enclosure portion 22, 22P are preferably staked or otherwise attached to the ground or another support surface, for example using stake tabs 19 oriented generally radially and positioned at intervals along the periphery of the lower enclosure portion. Various portions of the lower enclosure portion may also have connections for guying out, or attaching lines to anchor regions of the lower enclosure portion to the ground. Anchoring of the lower enclosure portion to the ground or another support structure creates a lower terminus for supporting the pre-stressed fabric structure. The arrangement of the external suspension web suspending a peripheral support element, in combination with one or more apical support element(s) for supporting an apex of the shelter and enclosure portions and an anchored base at the opposite support terminus, provides a stable structure in which the shelter and enclosure portions, and external suspension web, are maintained under tension while the apical and peripheral support elements and the base anchoring portions are maintained under compression.

It will be appreciated that a variety of shelter structures having different geometries that employ the structural elements described herein, including one or more apical support elements, one or more peripheral support elements supported by one or more external suspension web(s), an upper shelter portion, and an (optional) lower enclosure portion may be provided. Various configurations of upper shelter portions and external suspension webs may be used, and may be combined with various configurations of lower enclosure portions. In some embodiments, the configurations of the lower enclosure portions and upper shelter portions match one another, while in other embodiments, the configurations of the lower enclosure and upper shelter portions may be different. In some embodiments, an overhead canopy structure may be erected without a lower enclosure portion by providing one or more internal or external central support element(s) supporting the apex of an upper shelter portion and positioning one or more peripheral support elements in an external suspension web. A base region of the upper shelter portion and/or the external suspension web may be anchored to the ground or to another stationary structure in the absence of a lower enclosure portion to provide the desired lower support terminus for balancing the tensile forces.

Structures of the present invention may be erected in various ways to provide different internal spaces. In some embodiments, the length of one or more apical support element(s) may be varied to provide shelter structures having different configurations. In one arrangement, for example, when one or more apical support element(s) are used to support the apex of the upper shelter portion at a higher location, increased standing room and floor space is provided. In an alternative arrangement, when one or more apical support element(s) are used to support the apex of the upper shelter portion at a lower location, the structure has a generally lower profile, the side walls of the enclosure portion have a lower profile and may have less surface area, and the structure may be better able to withstand extreme conditions, such as high winds and storms. The same structural elements may thus be arranged to provide different internal volumes simply by raising and lowering the position of the apex of the upper shelter portion and, optionally, by using anchoring points provided at different locations along the side walls. Asymmetrical structures may be supported from one or more centrally positioned, or off-center, apical support element(s). Floors may be provided in the structures by permanently or detachably attaching a floor component having a footprint that substantially matches the configuration of the base region of the enclosure portion.

Figure 2A:
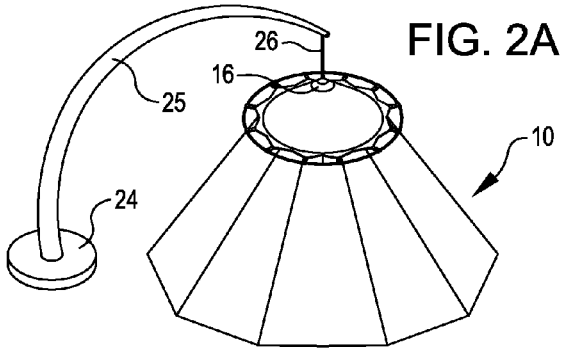
FIGS. 2A-2D schematically illustrate structures of the present invention employing an external rather than internal apical support element for supporting an apex of the upper shelter portion.
Figure 2B:
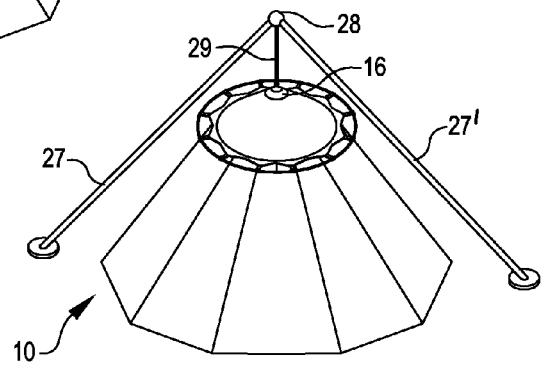
Figure 2C:
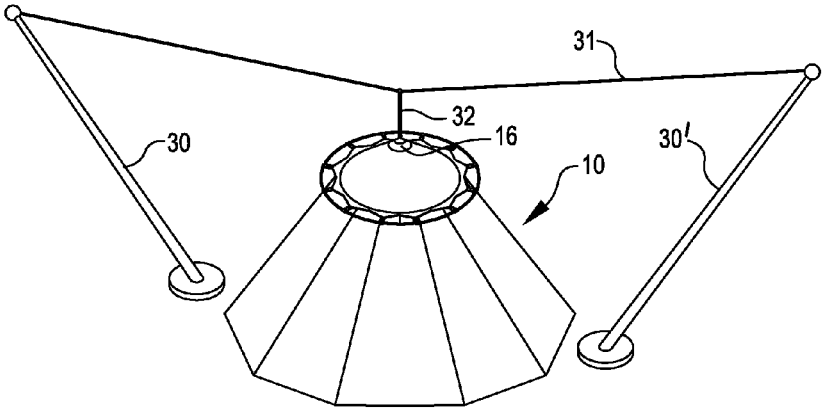
Figure 2D:
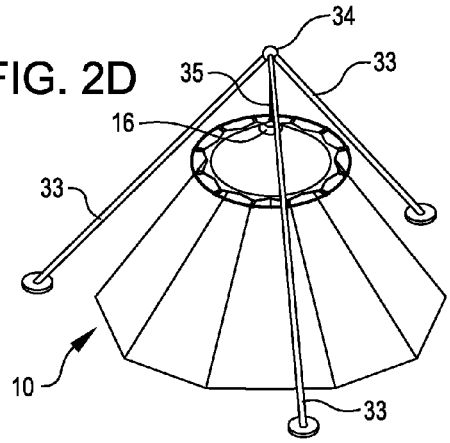

FIGS. 2A-2D illustrate structures having an external rather than internal apical support element for supporting the apex of the upper shelter portion. Essentially any stable overhead structure may be used to support the apex of the upper shelter portion from an external location, such as a tree limb, an existing structural beam, a line or cable strung between opposed support elements, a bipod or tripod structure, a curved or angular anchored structure, a cantilevered structure, or the like. FIG. 2A illustrates an external apical support element comprising a base 24, a curved support element 25 and a cable 26 for attachment to the apex 16 of the shelter structure 10. FIG. 2B illustrates an external apical support element comprising two support elements 27, 27' joined at one end at a central fixture 28, each of the support elements supported at the other end by the ground or another base support. Cable 29 may be suspended between central fixture 28, positioned above apex 16, and apex 16 of shelter structure 10. FIG. 2C illustrates an external support system having two support elements 30, 30' having a cable 31 suspended between extending ends of the support elements. Apex 16 of tent structure 10 may by suspended along cable 31 by attachment to another cable 32, or by interfacing with a fixture mounted, directed or indirectly at apex 16. FIG. 2D illustrates an external tripod structure comprising a plurality of supports 33 anchored to the ground or a support structure and intersecting at a fixture 34 positioned above apex 16. A cable 35 is provided for attachment of fixture 34 to apex 16, or a fixture provided at or near apex 16 may be supported by cable 35. Support elements 25, 27, 30 and 33 are preferably substantially rigid or semi-rigid and, in combination with other elements of the external support system, provide stable positioning of and external support at apex 16 of structure 10. It will be appreciated that many other types of external support structures may be provided. And, while reference is made to cables 26, 20, 31, 32 and 35, it will be appreciated that other flexible elements, such as lines, chains, webs, or the like may provide the desired support, in addition to other desirable characteristics, including portability, durability, lightweight properties, weather resistant properties, and the like.

Enlarged drawings of various embodiments of external suspension webs extending externally of a lower region of the upper canopy portion 14 and suspending peripheral support element 20 are shown in greater detail in FIGS. 3A-3F. In many embodiments, the external suspension web suspends the peripheral support element 20 a measurable distance externally of the transition region and bearing outwardly, away from the transition location 40. The external suspension web is taut when a peripheral support element is mounted extending externally of the transition region and suspension web, and tensile forces are exerted substantially uniformly and/or symmetrically along the transition region in the area of the external suspension web. The external suspension web generally extends and suspends peripheral support element 20 at least about 1 cm, or at least about 3 cm, or at least about 5 cm, or at least about 8 cm externally of the transition region. In some embodiments, the external suspension web suspends the peripheral support element 20 a distance of from about 3 cm to about 30 cm, or from about 3 cm to about 25 cm, or from about 5 cm to about 20 cm externally of the transition region. It will be appreciated that different distances may be appropriate for shelter structures having large or unusual dimensions and configurations.

When a circular or partially circular peripheral support element is used, the external suspension web is preferably configured to support the peripheral support element a substantially constant distance from the transition region along the perimeter of the peripheral support element. Thus, when the transition region forms a generally circular perimeter, the external suspension web is preferably configured to support a circular peripheral support element along a substantially concentric path externally of the transition region. When the transition region is generally polygonal and a corresponding polygonal peripheral support element is used, the suspension web is preferably configured to suspend the polygonal support element a substantially constant distance from the transition region along side regions of the polygon, with a different distance between the support element and transition region at corners of the polygonal structures. In alternative embodiments, when a circular or partially circular support element is used with structures having a polygonal transition region, the external suspension web is preferably configured to support the circular or partially circular support element in such a way that the perimeter of the polygonal transition region is substantially centered within the curved support element.

Structures of the present invention are typically configured so that when the structures are erected and a peripheral support element is suspended by the external suspension web, the external suspension web and the peripheral support element are arranged on a plane that is substantially parallel to the plane of the ground or another support surface. In structures that employ an internal apical support element, the external suspension web and the peripheral support element are typically (but not always) arranged on a plane that is substantially orthogonal to the axis of the apical support element. It may be desirable, in some embodiments, to provide structures in which a peripheral support element and external suspension web, when assembled, are arranged forming a plane that is not parallel to the plane of the ground but, rather, is arranged at an angle to the plane of the ground, or another support surface, or a structure floor. This arrangement may be preferred, for example, in structures having canopy and/or lower shelter portions that are arranged asymmetrically with respect to a central region or an apex of the upper canopy portion.

The combination of the external suspension web and the peripheral support element distributes forces substantially uniformly and/or symmetrically along and at the transition region. Substantially uniformly and/or symmetrically directed forces may be provided using an external suspension web having a substantially continuous interface with the transition region, and/or using an external suspension web having multiple elements, or tabs, that interface with the peripheral support element at intervals. The external suspension web may be constructed from a pliable material have substantially non-stretch properties, such as a reinforced sheet material. In alternative embodiments, the external suspension web may be constructed from a material that is stretchable to predetermined limits, or that has isotropic stretch characteristics. In some embodiments, the external suspension web may be constructed from a material that is rigid or semi-rigid.

Figure 3A:
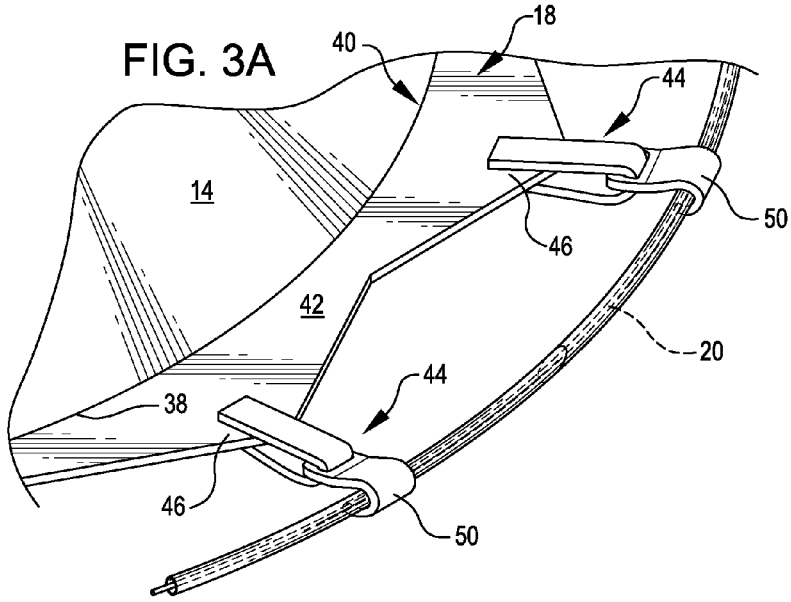
FIGS. 3A-3F show exemplary embodiments of externally directed peripheral suspension webs configured for supporting a peripheral support element at a lower region of an upper shelter portion, or at a transition region of a structure.

In the embodiment shown in FIG. 3A, an inner edge of external suspension web 18 has a configuration that generally matches the configuration of the transition region 40 and extends from and is anchored (directly or indirectly) to a base region of upper shelter portion 14, and/or to an upper region of the lower enclosure portion, or both. In one embodiment, external suspension web 18 is sewn or bonded or otherwise attached to both a base region of upper shelter portion 14 and an upper region of the lower enclosure portion as part of substantially continuous transition or interface region 40. In embodiment illustrated in FIG. 3A, external suspension web 18 comprises a web member 42 mounted to upper shelter portion 14 and/or lower enclosure portion 22 at transition region 40 and a plurality of attachment mechanisms 44 extending peripherally from portions of the web for mounting, and retaining, peripheral support element 20. In this embodiment, web member 42 preferably has a continuous inner edge 38 having a size and configuration (e.g., generally circular) that matches the size and configuration of the base region of upper shelter portion 14 and is joined or attached or sealed to the upper shelter portion and/or the lower enclosure portion substantially continuously at or near transition region 40.

Figure 3B:
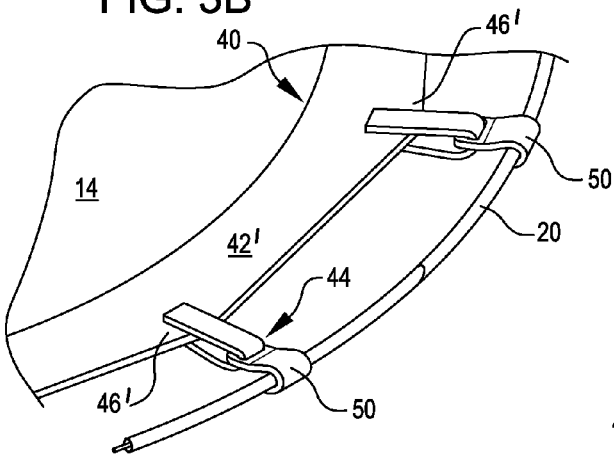

In some embodiments, web member 42 may comprise a generally annular band having generally concentric inner and outer edges, and having fasteners spaced at intervals along the outer edge for attachment of a peripheral support element 20. In alternative embodiments, as shown in FIGS. 3A and 3B, web member 42, 42' incorporates or interfaces with a plurality of extending portions or tabs 46, 46' arranged at regular intervals along its outer edge. The tabs may be provided as an integral part of web member 42, 42', as illustrated, or they may be provided as distinct elements attached or mounted to web member 42, 42'. The outer (external) edges of the web member 42 extending between tabs 46 may have an inwardly angled configuration as shown in FIG. 3A, forming generally triangular-shaped tabs 46. In another embodiment, the outer edges of web member 42' extending between tabs 46' may form a generally straight line, forming a generally polygonal outer edge of web member 42', as shown in FIG. 3B. In yet another embodiment (not illustrated here but shown and described later with respect to a base suspension web), the outer edges of the web member in the regions extending between spaced tabs may have an inwardly curved configuration (e.g., a generally catenary curved configuration).

Figure 3C:
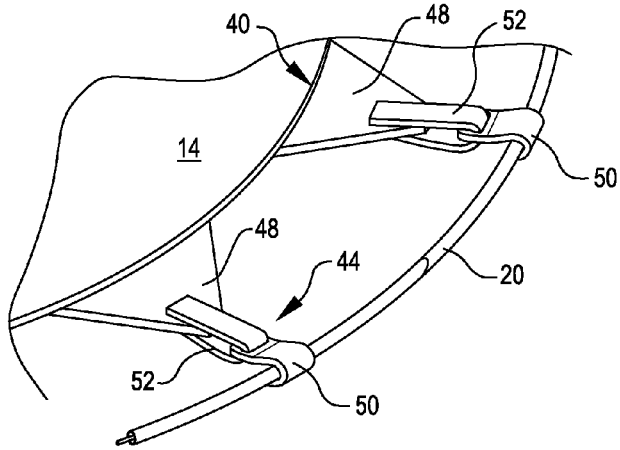

FIG. 3C illustrates another embodiment of an external suspension web for supporting peripheral support element 20 formed as a plurality of spaced tabs 48 extending from transition region 40 and supporting externally directed attachment mechanisms 44. Spaced tabs 48 may be anchored (directly or indirectly) to a base region of upper shelter portion 14, and/or to an upper region of the lower enclosure portion, or both, and may form part of substantially continuous transition or interface region 40. Tabs 48 are illustrated as being generally triangular, with a wider interface portion positioned toward the transition region and a narrower support portion positioned externally away from the transition region, near an interface with a peripheral support member.

Fasteners for retaining the peripheral support element 20 are generally provided at the narrower external support portion of tabs 48. In alternative embodiments, the peripheral suspension web may comprise a series of straps with attachment mechanisms provided at regular intervals along the transition region for suspending a peripheral support element a substantially constant distance away from the transition region. In some embodiments, it may be desirable to provide an external suspension web comprising the combination of a substantially non-stretch band extending at and around the transition region, for example by bonding or sewing or otherwise attaching a substantially non-stretch element around the transition region and a plurality of externally extending tabs or straps extending externally of the band at regular intervals along the transition region. In these embodiments, mounting extending tabs or straps directly or indirectly to the band facilitates uniform distribution of the load along the transition region.

The number of extending tabs 46, 46', 48 may vary depending on various aspects of the structure's configuration, size and materials of construction, but at least three extending tabs are generally provided, and more than three tabs are preferred for many applications. In preferred embodiments, the extending tabs are arranged in a radially symmetrical manner around at least a portion of the transition region and the number of extending tabs 46, 46', 48 is sufficient to distribute forces substantially uniformly along the transition region 40 when the peripheral support element 20 is installed. In many embodiments, the material forming extending tabs 46, 46', 48 and stabilizing band 49 may be substantially non-stretchy, or may have substantially isotropic stretch characteristics.

One or more attachment mechanisms 44 is provided, typically at or near an outermost area of extending tabs 46, 46', 48. Attachment mechanisms 44 may be provided as various types of clips, hooks, straps, buckles, loops, anchors, sleeves, pockets, fasteners, and the like, suitable for capturing and retaining peripheral support element 20. In some embodiments, attachment mechanism 44 comprises a securing mechanism 50 comprising a clip or a hook or another fixture suitable for capturing and securing a peripheral support element, and strap 52 provides flexible and (optionally) adjustable positioning of securing mechanism 50. Attachment, securing and adjustment mechanisms may be adjustable, in various ways, to accommodate and retain different types, sizes, perimeter dimensions and profiles of peripheral support elements, and (optionally) to vary the distance of the peripheral support element from the transition region. It will be appreciated that many different types of attachment, securing and adjustment mechanisms may be used for this purpose.

Figure 3D:
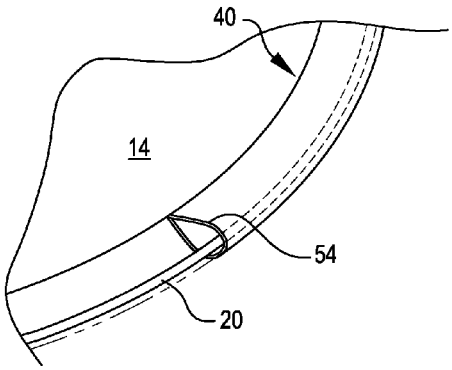
Figure 3E:
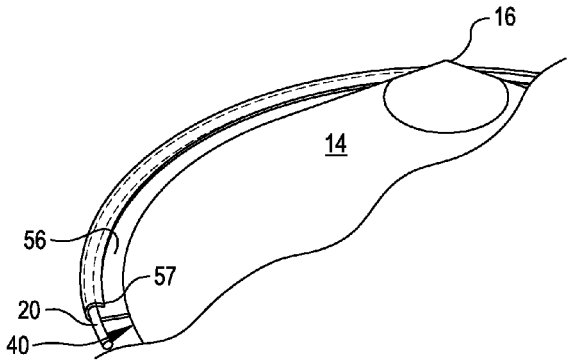
Figure 3F:
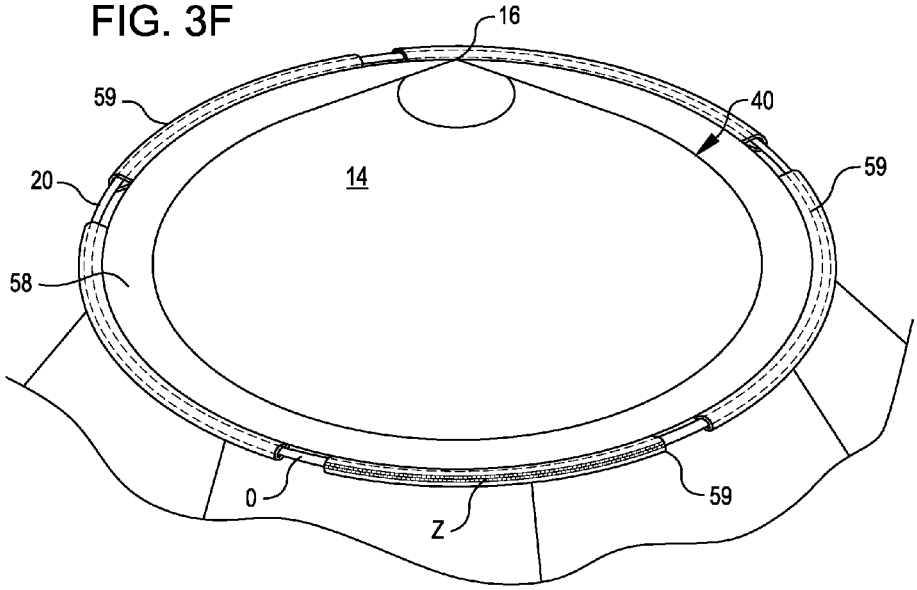

FIGS. 3D-3F show additional exemplary embodiments of external suspension webs for suspending a peripheral support element externally of a transition region between a base region of an upper shelter portion and an upper region of a lower enclosure portion of the structure. FIG. 3D schematically illustrates a section of a simple sleeve element 54 provided as the external suspension web and retaining peripheral support element 20. An internally directed edge of sleeve 54 may be joined or attached or sealed to the upper shelter portion and/or the lower enclosure portion at or near transition region 40 and, in this embodiment, the peripheral support member 20 generally bears against an opposite surface of the sleeve when the structure is erected. The sleeve thus serves to suspend the peripheral support member at a distance externally of the transition region and also serves to distribute forces substantially uniformly along the transition region. The sleeve structure may extend continuously or discontinuously around the transition region.

FIG. 3E schematically illustrates yet another embodiment in which an external suspension web is provided as a retaining web 56 having an inner edge that matches the size and configuration and is joined or attached or sealed to the transition region 40, and one or more pockets 57 positioned externally of the inner edge and facing inwardly toward the transition area. The pocket(s) 57 may be oriented and accessible from either above or below the retaining web 56, and peripheral support element 20 is insertable into and captured between the retaining web and the inner surface of the capturing pockets. It will be appreciated that a single continuous capturing pocket having an open inner edge may be provided, or that a plurality of capturing pockets may be provided at intervals along retaining web 56.

FIG. 3F schematically illustrates an embodiment in which an external suspension web comprises an externally directed band 58 having a substantially continuous inner edge that matches the size and configuration and is joined or attached or sealed to transition region 40. In this embodiment, one or more sleeve segment(s) 59 is attached or mounted to an outer edge of band 58 for retaining a peripheral support member. Access to the interior portion of the sleeve for insertion or removal of the peripheral support member in the sleeve may be provided by one or more accessible region(s) such as zippered region(s) Z, one or more non-continuous or open region(s) O, or by a combination of open and accessible regions providing suspension of peripheral support member 20. Tabs and fasteners may be used to support the peripheral support member, if necessary or desired, at one or more open regions provided between sleeve segments.

It will be appreciated that the external suspension web may take a variety of forms, any of which function to support a peripheral support element a distance externally of the transition region and to distribute forces substantially evenly and/or symmetrically along the transition region. Additional embodiments of external suspension webs, not specifically illustrated in the exemplary embodiments described above, are intended to be encompassed within the disclosure and claims of this application.

Figure 4A:
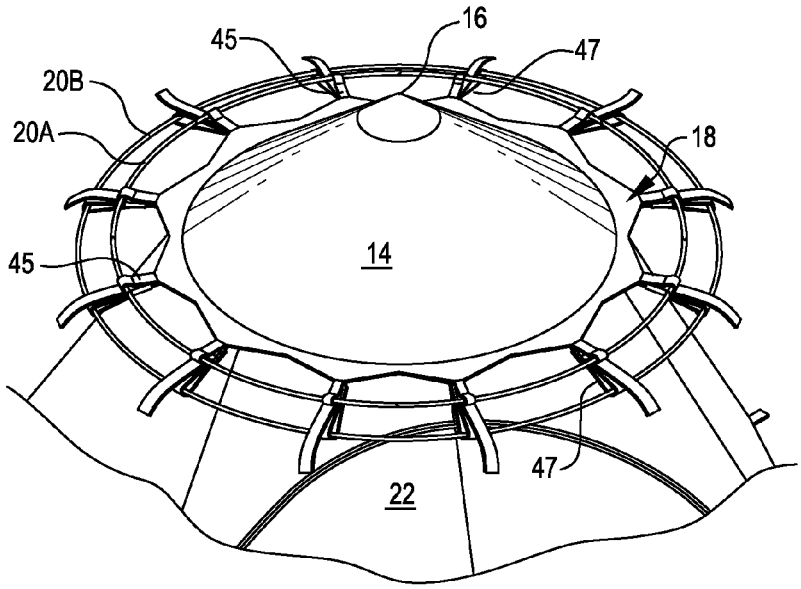
FIG. 4A shows a partial perspective view of the exterior of an assembled fabric structure similar to that shown in FIGS. 1A and 1B having an external peripheral suspension web and supporting two peripheral support elements having different perimeters.
Figure 4B:
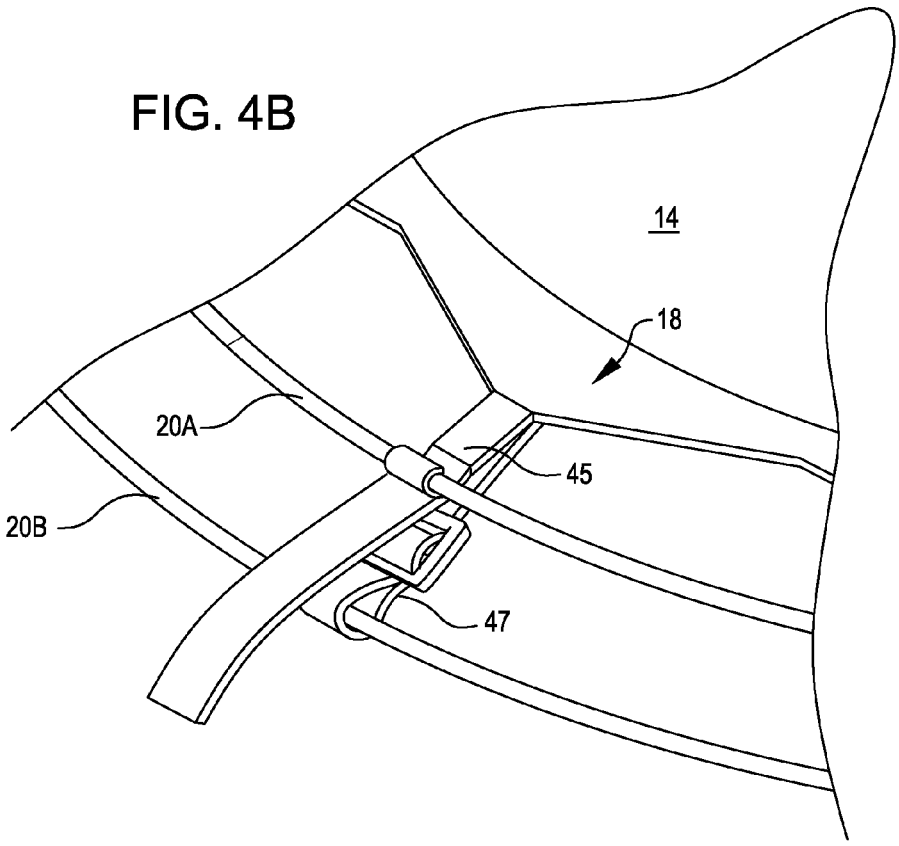
FIG. 4B shows an enlarged view illustrating the mounting of peripheral support elements to the external peripheral suspension web.

FIGS. 4A and 4B illustrate an embodiment wherein multiple external peripheral support elements 20A, 20B are provided, each of the support elements having a different perimeter dimension. Providing multiple peripheral support elements may provide additional structural stability and strength for the structure, and it may provide greater flexibility for using various types of accessories. In the embodiment shown in FIGS. 4A and 4B, peripheral support elements 20A, 20B are both circular and one has a larger perimeter (i.e., diameter) than the other. Multiple peripheral support elements may have the same or different diameters, and they may be constructed from the same or different materials. Although common attachment mechanisms may be provided for attachment of multiple peripheral support elements, additional attachment mechanisms are preferably provided for attaching multiple peripheral support element(s), allowing each peripheral support element to be suspended independently from the structure's transition region.

In the embodiment illustrated in FIGS. 4A and 4B, an external suspension web 18 has clip mechanisms 45 projecting externally of the suspension web for capturing and suspending an inner peripheral support element 20A, while adjustable strap mechanisms 47 are provided for capturing and suspending outer peripheral support element 20B. Adjustable straps 47 or other attachment mechanisms for supporting a peripheral support element may be mounted (directly or indirectly) to a portion of the external suspension web, or they may be mounted (directly or indirectly) to the upper shelter portion and/or the lower enclosure portion at or near the transition region. In some embodiments (not shown), the locations of attachment mechanisms for mounting multiple peripheral support elements are radially offset from rather than aligned with one another around the periphery of the transition region. It will be appreciated that many different types of attachment mechanisms may be employed, including various types of clips, hooks, anchors, straps, buckles, loops, fasteners, and the like.

Figure 5A:
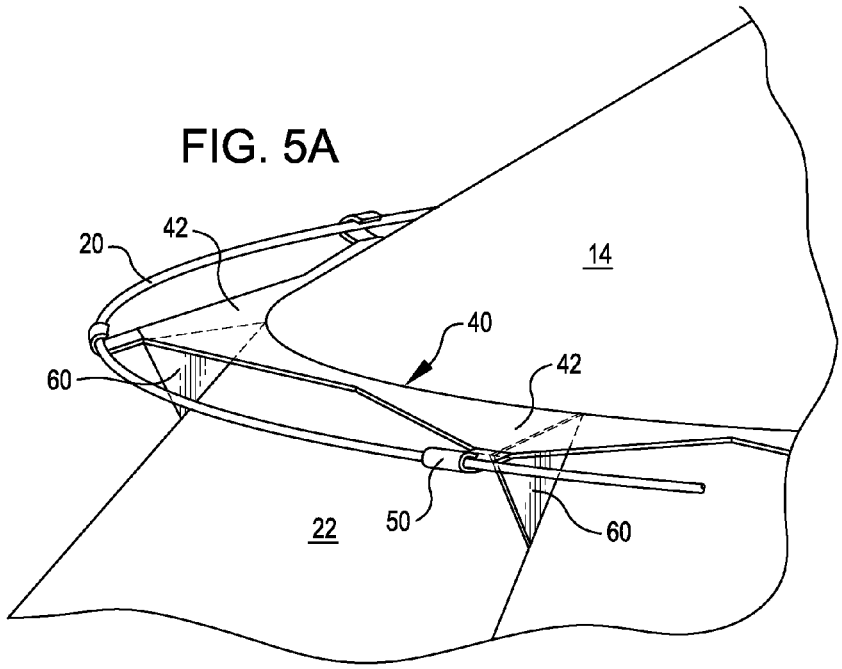
FIGS. 5A and 5B show exemplary external and internal buttressing elements mounted for stabilizing the transition region and external suspension web.
Figure 5B:
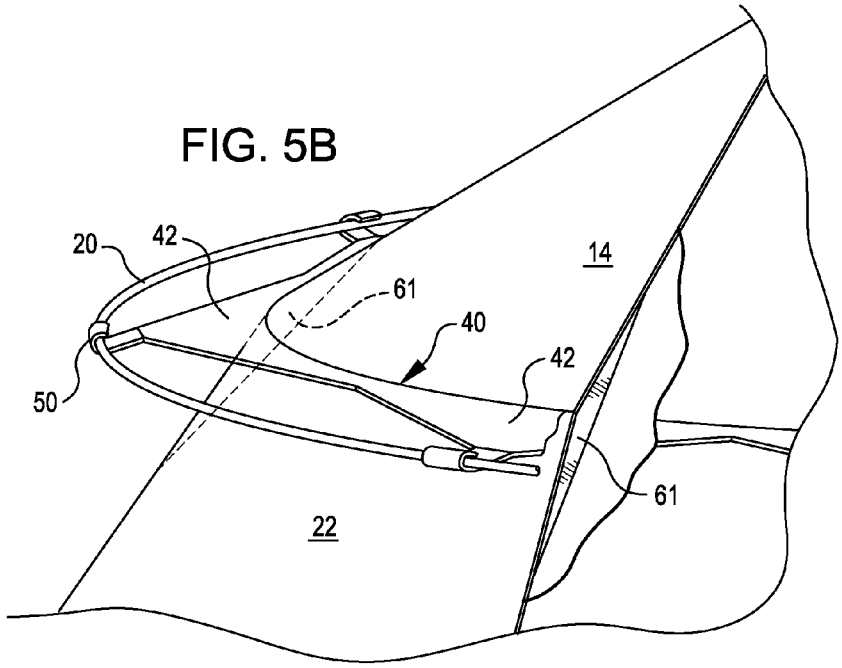

External and/or internal buttressing elements may be provided for stabilizing the external suspension web and peripheral support element and/or the transition region. FIG. 5A schematically illustrates an exemplary embodiment of external buttressing elements, and FIG. 5B schematically illustrates an exemplary embodiment of internal buttressing elements. FIG. 5A shows an embodiment similar to that illustrated in FIG. 3A, wherein an external suspension web 42 incorporates or interfaces with a plurality of extending portions or tabs arranged at regular intervals along its outer edge, with the tabs having attachment support mechanisms in the form of clips 50 for mounting peripheral support element 20. Multiple external buttress elements 60 are provided extending below the external suspension web.

External buttress elements 60 generally provide a physical link between lower enclosure structure 22 and the external suspension web 42 and (indirectly) peripheral support element 20 and tend to stabilize the external suspension web and peripheral support element when loads are applied, such as from high winds. Several external buttress elements 60 may be provided at intervals below the external suspension web, as shown, and may be bonded, sewn, or otherwise attached to the external suspension web and the lower enclosure portion. While the external buttress elements are illustrated as generally triangular structures, it will be appreciated that other types of external buttress elements, such as cords, straps, and the like, may be provided to link the external suspension web to the lower enclosure portion in addition or alternatively to the external buttress elements shown. External buttress elements are preferably fabricated from pliable materials that have low or substantially no-stretch properties, and/or that have isotropic stretch properties.

FIG. 5B schematically illustrates another embodiment in which internal buttress elements 61 are provided, linking the upper canopy portion 14 and a lower enclosure portion 22 in the area of the transition region 40. These internal buttress elements 61 provide additional support and stability to the transition region, which helps to stabilize the peripheral suspension web and peripheral support element when loads are applied. Several internal buttress elements 61 may be provided internally at intervals around the transition region, as shown, and may be bonded, sewn, or otherwise attached to the internal canopy, the lower enclosure portion and, optionally, the transition region. In one embodiment, internal buttress elements 61 may be bonded or sewn or otherwise attached to the canopy 14 and lower enclosure portions 22 at fabric seams. While the internal buttress elements 61 are illustrated as generally triangular structures, it will be appreciated that other types of internal buttress elements, including cords, straps, and the like, may be provided to link the upper canopy and lower enclosure portions. Internal buttress elements are preferably fabricated from pliable materials that have low or substantially no-stretch properties, and/or that have isotropic stretch properties. Structures of the present invention may incorporate both internal and external buttress elements.

Peripheral support elements (20, 20A, 20B) comprising many different materials and having various cross-sectional profiles and sizes may be used. Exemplary cross-sectional profiles include: rectangular profiles having the longer dimension arranged in the vertical direction when in use; rectangular profiles having the longer dimension arranged in the horizontal direction when in use; circular and substantially circular profiles; oval or oblong profiles with the longer axis arranged in the vertical direction when in use; and oval and oblong profiles with the longer axis arranged in the horizontal direction when in use. Peripheral support elements having a substantially flat profile may also be used.

Peripheral support element(s) for use with structures having a generally round transition region have a generally continuous curved form when assembled and are generally lightweight. In many embodiments, the peripheral support element(s) form a substantially continuous, closed circular form when assembled, while in other embodiments the peripheral support element(s) form a continuous curved and partially circular form when assembled. Peripheral support elements are generally substantially rigid along their longitudinal axis and form, or can be arranged to form, a continuous structural element that is at least somewhat rigid with respect to the plane defined by the continuous form when assembled. Peripheral support elements may be provided as a single, continuous structural element, such as a rod that can be arranged to form a hoop, or they may be provided as multiple constituent members that, when assembled (generally, end to end) provide a continuous, curved structural element. Disassembled peripheral support elements may be provided as pre-bent, partially pre-bent or straight sections that can be temporarily bowed to the assembled, curved form of the peripheral support element used in the erected structure.

Many different types of support elements are suitable, including conventional tent poles comprising multiple tubular members that may be detachably joined to or interlocked with one another to form an integral structural element, such as shock-corded or other types of joinable but collapsible or detachable members. Tubular sections designed to be joined to one another for applications such as tent poles generally have ends cut at a right angle to the axis of the section, with adjacent sections meeting by abutting (and/or interlocking) blunt ends of adjacent sections. These types of section joints are suitable for many applications, but they permit rotation and twisting of the adjacent sections with respect to one another. In alternative embodiments, adjacent tubular sections are provided with mating, or mirror image angular ends arranged on a bias, and adjoining ends meet and abut only in one rotational orientation. This embodiment provides structural interlocking members that, in combination, provide an integrated, longer scarfed joint characterized by controlled and limited torsional twisting and rotation of adjacent sections. Providing adjoining tubular sections having angled or biased end configurations also facilitates alignment and orientation of curved or angled tubular sections during assembly to produce the desired assembled configuration.

Constituent members or sections that are assembled to provide a generally continuous, curved form may be fabricated from individual members having a curved, arced configuration, or from individual members having linear configurations that, when assembled end to end to form a linear rod, may then be arranged in a continuous curved and/or closed circular configuration. Peripheral support elements may be constructed as unitary elements or as constituent members or sections from materials such as generally lightweight metallic and polymeric materials, natural materials such as bamboo and other woods, substantially rigid plastics and composite materials, and the like.

The structures described herein may be characterized as tensile structures, with the upper shelter portion and the (optional) lower enclosure portion being pre-stressed when the structures are erected and thereafter maintained substantially in tension. In these structures, the peripheral support element serves as an external, "floating" or "suspended" compression element. The suspended peripheral compression element is joined to the structure via the external suspension web at the transition region between the upper and lower fabric components of the structure. The forces applied above and below the transition region by the suspended peripheral support element are preferably applied substantially uniformly and/or symmetrically around the perimeter of the transition region. Because these structures perform best when the upper shelter portion and lower enclosure portions are under substantially uniform tension and remain under substantially uniform tension during their lifetimes, it is generally desirable to fabricate the structures using materials having low stretch characteristics, and/or having limited and pre-determined or substantially uniform stretch characteristics in all directions. Because using these types of materials is not always practical or cost effective, the upper shelter and (optional) lower enclosure portions may be constructed from woven materials that exhibit different stretch characteristics in different directions. In these circumstances, attention must be paid to the weave orientation and the stretch characteristics of the fabric as oriented relative to the transition region.

FIGS. 6A-D show exemplary eave and band structures provided in proximity to and below the external suspension web at a transition region. Eave and band structures may be arranged below an externally directed suspension web, and may thus be sheltered from rain, snow, and the like, while providing desired ventilation and air flow into and through the structure. Eaves may be fabricated from a material that is different from the material used for upper and/or lower shelter portions and may be provided as wholly or partially screen- or mesh-like fabric structures to facilitate ventilation and air flow from outside to inside the structure and vice versa. The edges of fabric eaves may be mounted to other fabric components directly or indirectly using reinforcing and stabilizing materials, such as materials having low- or no-stretch characteristics, and/or materials having limited and pre-determined or substantially uniform stretch characteristics in all directions. In some embodiments, an eave may extend around the full perimeter of the structure; in other embodiments an eave may extend partially around the perimeter of the structure, or a plurality of eave segments may be provided at different locations around the perimeter of the structure below an externally directed suspension web.

Figure 6A:
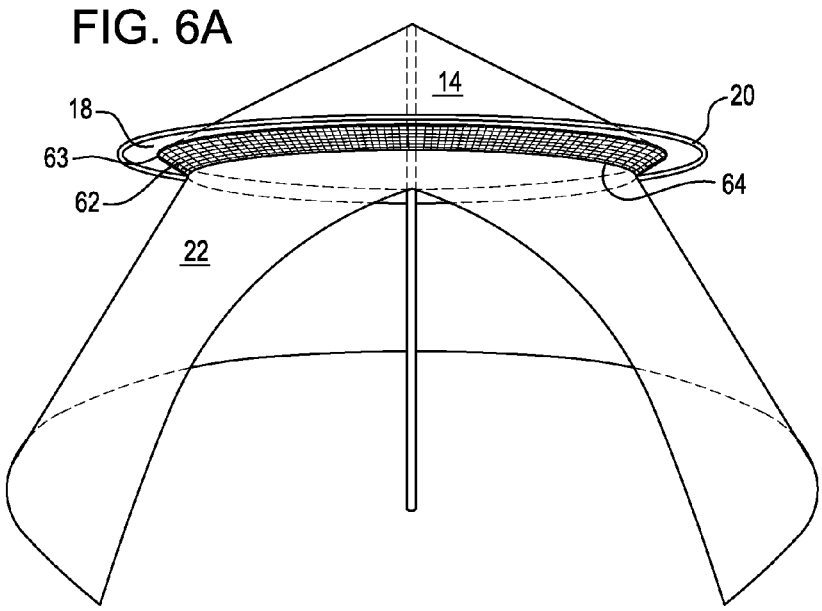
FIGS. 6A-D show exemplary eave and band structures provided in proximity to the external suspension web at a transition region.

FIG. 6A schematically illustrates an embodiment in which an eave 62 has an annular configuration and is positioned below the external suspension web and between the external suspension web (and/or the transition region) and an upper region of the lower shelter portion. This arrangement provides an eave configuration that extends downwardly and inwardly from a portion of the suspension web and/or the transition region. In this embodiment, a larger diameter edge 63 of eave 62 is mounted below the suspension web 18 and peripheral support element 20, and a smaller diameter edge 64 of eave 62 is mounted to an upper region of lower shelter portion 22.

Figure 6B:
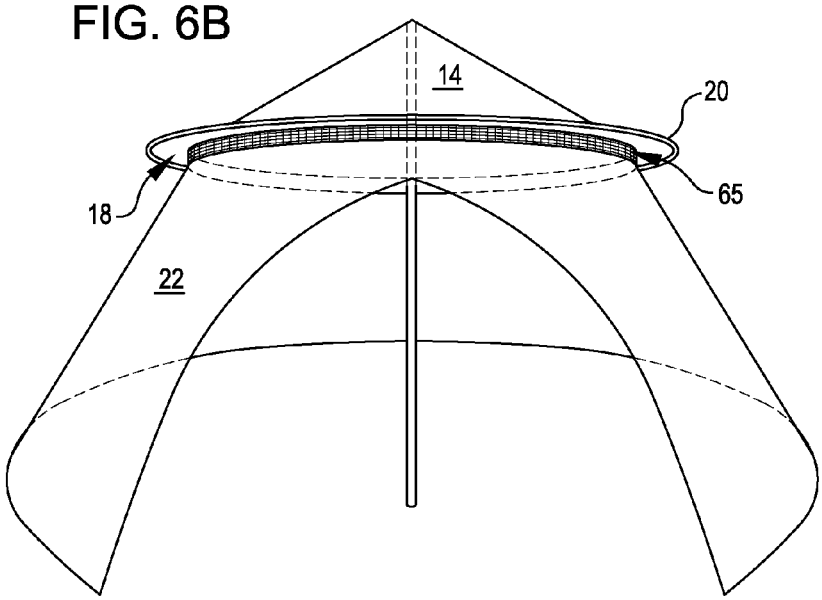
Figure 6C:
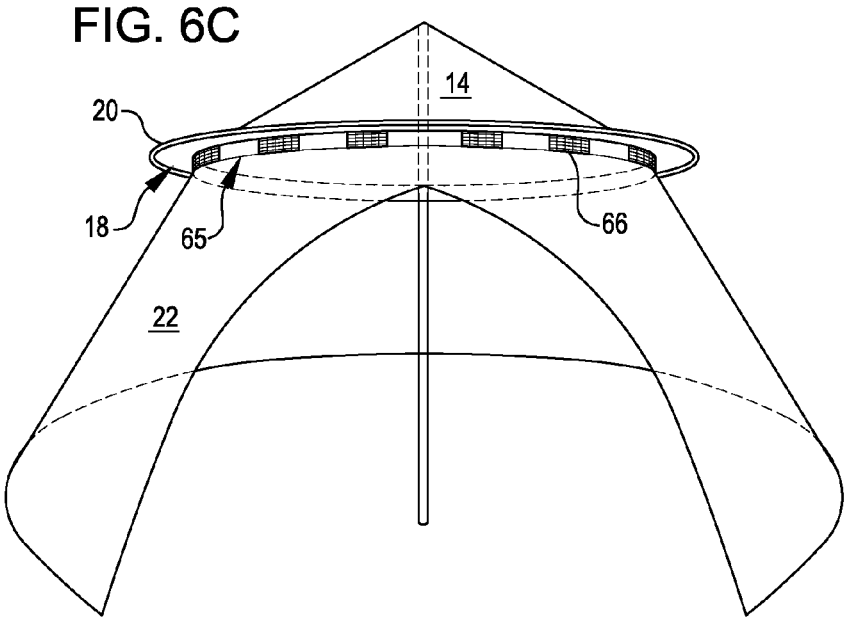
Figure 6D:
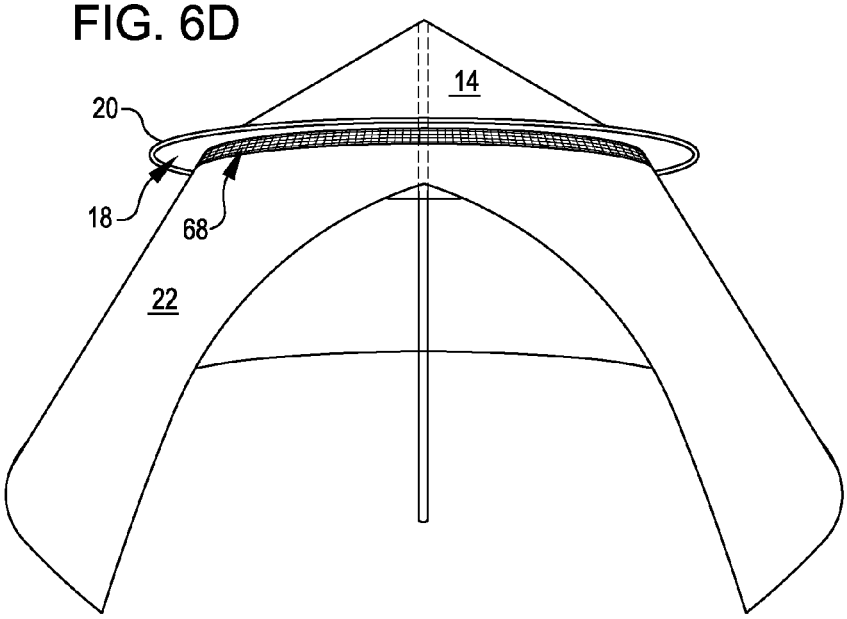

FIG. 6B schematically illustrates an embodiment in which an eave 65 having a generally cylindrical configuration is positioned below and between an inner edge of the external suspension web 18 (and/or the transition region) and an upper edge of lower shelter portion 22, providing a downwardly directed, generally cylindrical band. FIG. 6C schematically illustrates an eave 65 having a generally cylindrical configuration and location as shown in FIG. 6B, wherein the eave incorporates regions having different structural and/or functional properties, including air permeable ventilation regions 66. FIG. 6D schematically illustrates yet another embodiment in which an eave 68 is mounted below external suspension web 18 and is configured as an extension of an upper region of the lower enclosure portion of the fabric structure. In this embodiment, eave 68 has an annular configuration with a smaller diameter upper edge mounted to an inner edge of the external suspension web 18 (and/or the transition region) and a larger diameter lower edge mounted to an upper edge of the lower shelter portion 22. In the eave embodiments shown in FIGS. 6B-6D, the eave structure may be configured and arranged such that it may be wholly or partly "closed" or folded away or covered to restrict air flow and ventilation as desired.

Figure 7A:
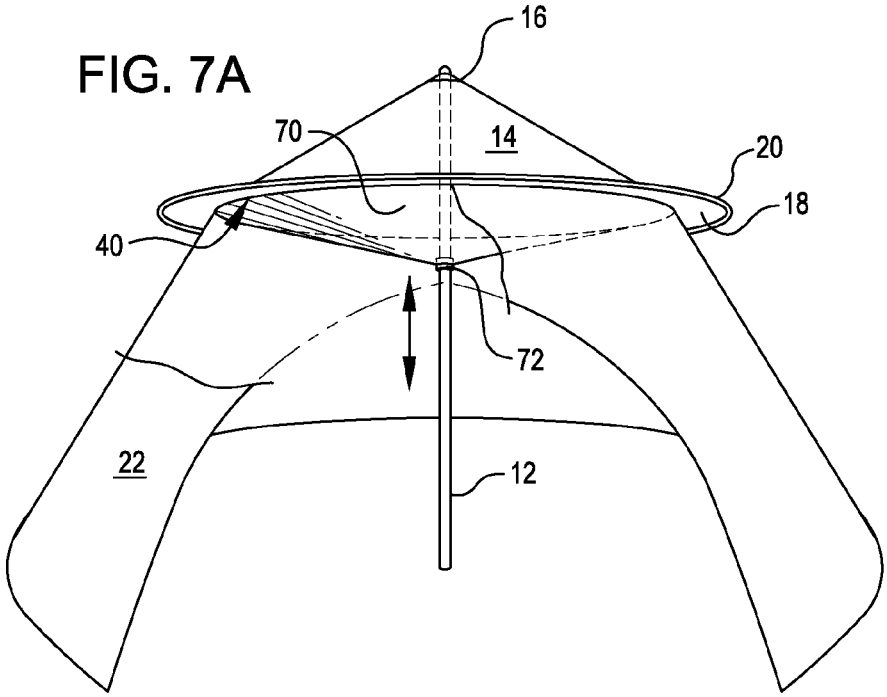
FIGS. 7A-7C show schematic drawings illustrating internal tensioning elements.
Figure 7B:
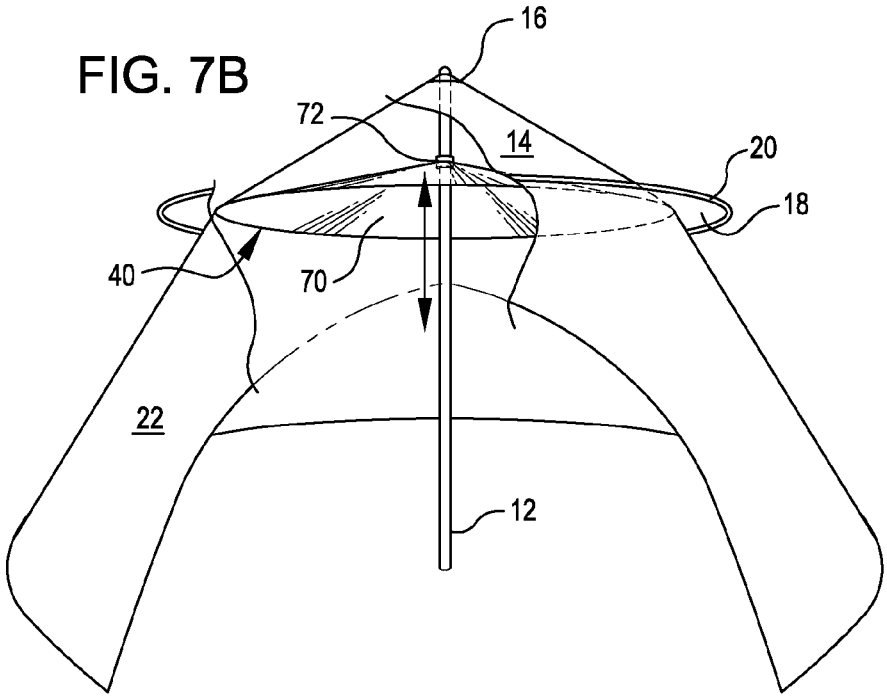

FIGS. 7A and 7B show schematic drawings illustrating an internal tensioning liner provided in connection with structures of the present invention supported by one or more peripheral support members. In the embodiments illustrated, the shelter structure, when erected, employs an internal apical support element 12 supporting an apex 16 of upper shelter portion 14. An external suspension web 18 extends externally from a transition region 40 at the interface of upper shelter portion 14 and lower enclosure portion 22 and supports a peripheral support element 20 provided as a continuous, closed circular rod. In this embodiment, an inwardly directed stabilizing structure 70 extends inwardly from the transition region 40 toward the center of the structure and forms a generally inverted cone-shaped tensioning structure. A central area of stabilizing structure 70 may be mounted to an internal apical support element 12, as shown, to exert inwardly directed forces on the structure at the transition region in a substantially uniform and symmetrical manner. Providing an internally directed, inverted cone-shaped tensioning structure to direct forces inwardly from the transition region toward the center of the structure provides additional rigidity and stability and is particularly useful when the structure is subjected to harsh conditions such as high winds. In some embodiments, an internal cone-shaped structure, whether under tension or not, may also provide an insulating layer to reduce heat loss from and condensation in the internal volume below the tensioning structure. In some embodiments, the internal space between the upper canopy and the stabilizing structure may be used for storage or for other purposes.

In some embodiments, as shown in FIGS. 7A and 7B, an internal edge of stabilizing structure 70 may be mounted to a central collar 72 that is movable along apical support element 12 to provide adjustable positioning of stabilizing structure 70 in a generally downwardly-directed orientation as shown in FIG. 7A, or in a generally upwardly-directed orientation as shown in FIG. 7B. Central collar 72 may be adjustable to provide both movement along and stable positioning of the collar at different locations on apical support element 12. Predetermined stops or positions may be arranged by cooperation of collar 72 and the apical support element to provide stable positioning of collar 72 at different areas along apical support element, thereby providing positioning of stabilizing structure 70 in different orientations.

Figure 7C:
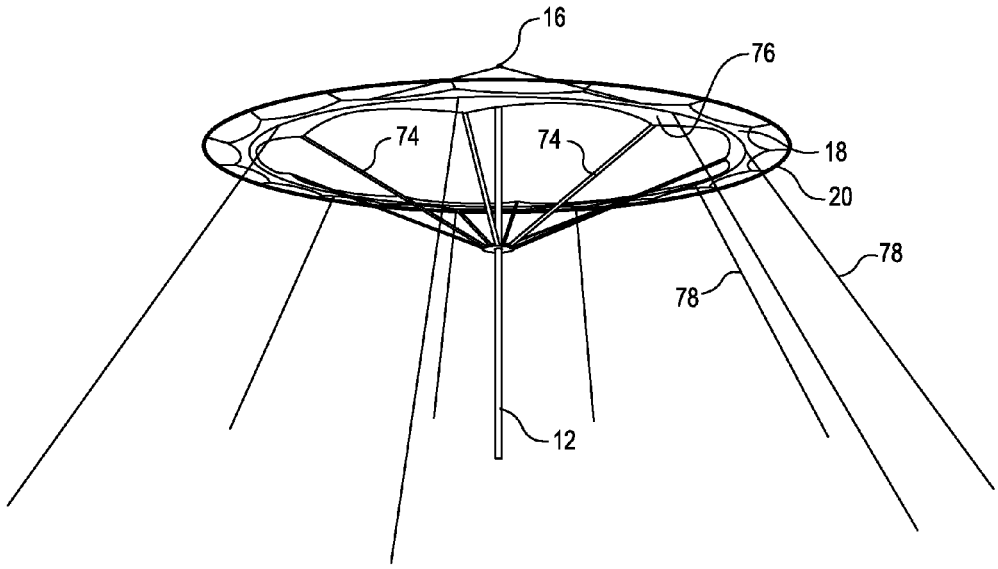

While stabilizing structure 70 is shown as a substantially solid, cone-shaped fabric structure in the illustrative embodiments of FIGS. 7A and 7B, it will be appreciated that alternative embodiments, in which stabilizing structure 70 comprises a webbing or net-like structure, or a framework structure incorporating series of straps or lines or cables, may also be used. FIG. 7C shows an embodiment of a canopy structure having an internal apical support element 12 supporting an apex 16 of an upper shelter portion. An external suspension web 18 extends externally from the lower perimeter of the upper shelter portion and supports a peripheral support element 20 in the form of a continuous, closed circular rod. In this embodiment, an inwardly directed stabilizing structure comprising a plurality of radially arranged straps 74, or cables or lines or the like, extends inwardly from the lower perimeter of the upper shelter portion toward the center of the structure and forms a generally inverted cone-shaped tensioning structure. Straps 74 may be mounted at or in proximity to the lower perimeter of the upper shelter portion and/or an inner perimeter of external suspension web 18.

In the embodiment illustrated in FIG. 7C, straps 74 are mounted on an inwardly directed web 76 mounted or mountable to and extending inwardly from the lower perimeter of the upper shelter portion and/or an inner perimeter of external suspension web 18. Internal edge ends of straps 74 may be mounted to a central collar 77 that is movable along apical support element 12 to provide variable tensioning and adjustable positioning of the stabilizing structure in a generally downwardly-directed orientation as shown in FIG. 7C, or in a generally upwardly-directed orientation. In canopy structures that lack sidewalls or lower enclosure portions, such as the canopy structure schematically illustrated in FIG. 7C, guy lines or cables 78 may additionally be provided extending from the lower perimeter of the upper shelter portion and/or an inner perimeter of external suspension web 18, or they may be mounted on an additional outwardly and downwardly directed web having a configuration similar to web 76 and attached to the lower perimeter of the upper shelter portion (not shown) to anchor the perimeter of the canopy structure to the ground or another stable support surface. The stabilizing structure, whether provided in a generally solid or strap-like form, is preferably fabricated from materials having low- or no-stretch characteristics, and/or having limited and pre-determined or substantially uniform stretch characteristics in all directions.

Figure 8A:
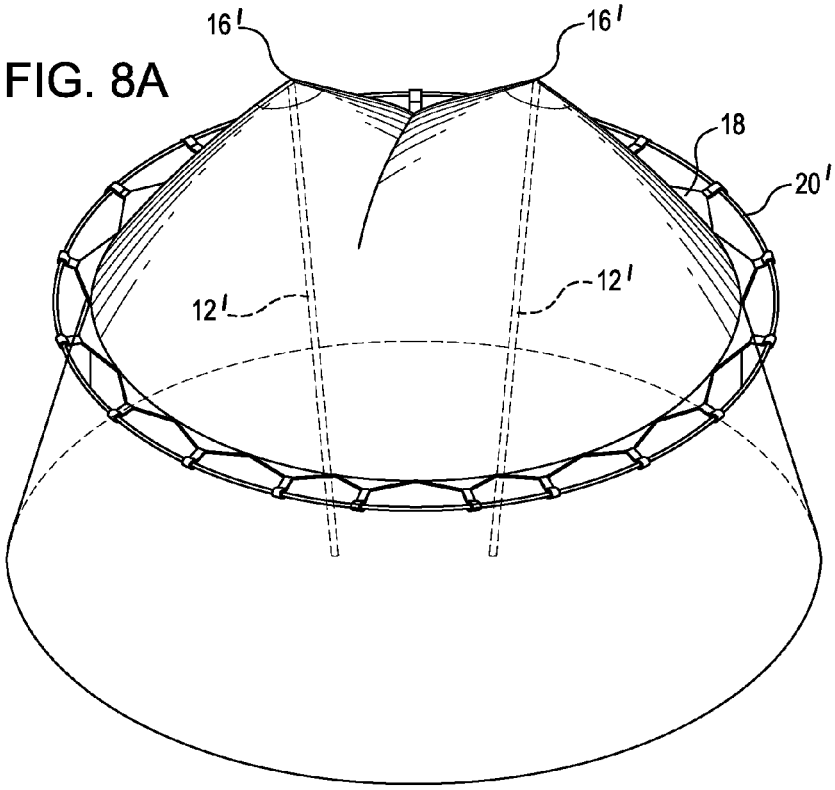
FIGS. 8A and 8B show schematic drawings of the exterior of an assembled fabric structure in the form of a tent having multiple apexes and multiple apical support elements.
Figure 8B:
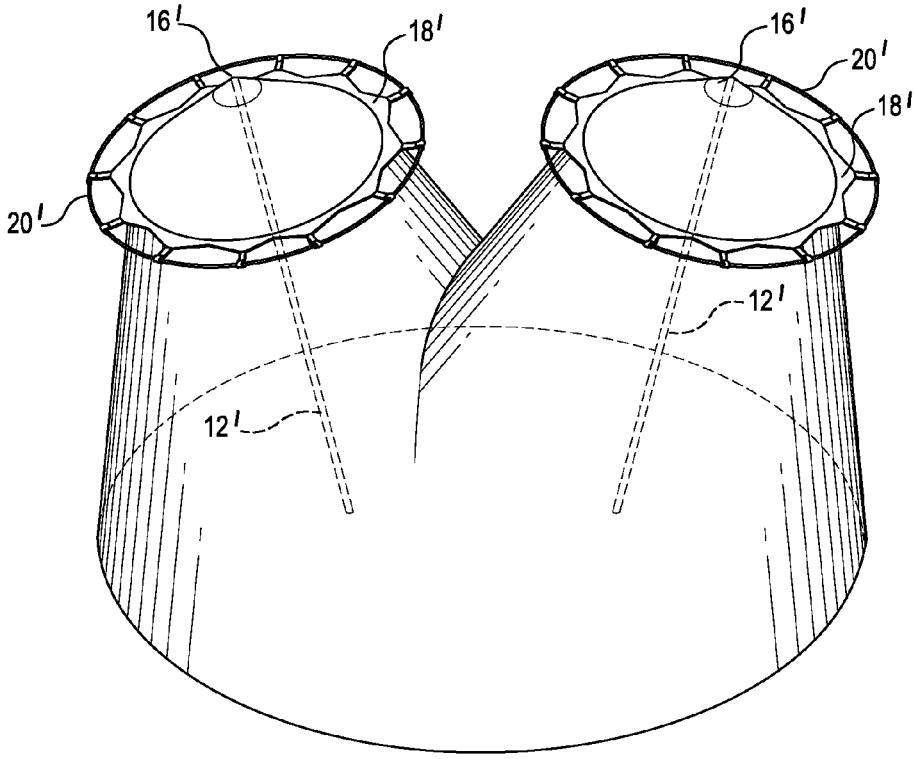

FIGS. 8A and 8B illustrate alternative structures of the present invention incorporating multiple apical support elements 12' supporting multiple upper shelter portion apexes 16'. The apical support elements may be erected at angles to one another and at non-right angles to the ground or support structure, although the apical support elements may be positioned and used as upright supports as well. The exemplary structure illustrated in FIG. 8A implements a single external suspension web 18 and a single peripheral support element 20, each having a generally round or slightly oval or elliptical configuration. The structure illustrated in FIG. 8B implements dual external retaining systems 18' and dual peripheral support elements 20'. These configurations may be employed, for example, in circumstances in which it may be desired to reduce the load resulting from the weight of the upper shelter portion by providing multiple central support elements, or to provide different configurations of internal volumes and different external appearances. Large structures, for example, may benefit from having multiple apexes and the support provided by multiple central support elements.

Figure 9:
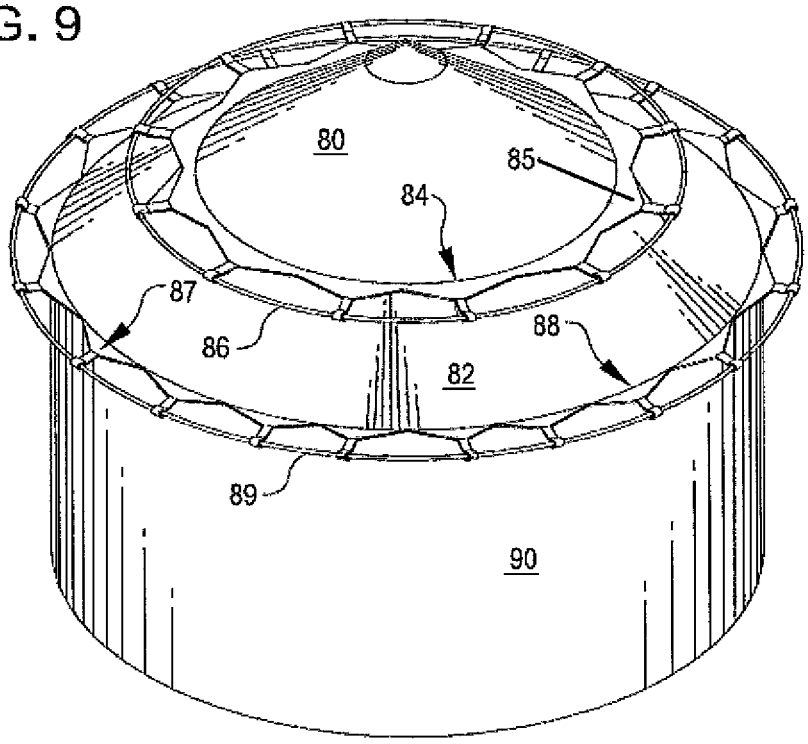
FIG. 9 shows a schematic drawing from an upper perspective view of the exterior of an assembled structure in the form of a tent having multiple external peripheral suspension webs with multiple peripheral support elements and a lower enclosure structure.

FIG. 9 illustrates another embodiment of a shelter structure employing multiple external suspension webs and multiple peripheral support elements. In this embodiment, an upper shelter portion is composed of multiple sections, including a conical upper central section 80 and a frustoconical lower peripheral section 82. The upper and lower sections of the shelter portion are connected to one another (directly or indirectly) at a first transition region 84, where a first external suspension web 85 captures and supports a first peripheral support element 86. The lower section 82 of the shelter portion is connected to a lower enclosure portion 90 at a second transition region 88, where a second suspension web 87 is mounted and supports a second peripheral support element 89. In the embodiment shown in FIG. 9, the structure is erected with the sidewalls of lower enclosure portion 90 arranged in a substantially upright orientation in which they're substantially orthogonal to the plane of the ground or other support surface. In alternative embodiments, the sidewalls of the lower enclosure may be arranged in an outwardly angled orientation in which the base of the lower enclosure portion is positioned at a greater distance from the center than is an upper region of the lower enclosure portion. The combination and arrangement of external suspension webs, peripheral support elements, shelter and enclosure portions provides a stable structure in which the shelter and enclosure portions and external suspension webs are maintained under tension while central and peripheral support elements are maintained under compression.

FIGS. 10A-10E schematically illustrate fabric structures of the present invention having an external suspension web 18 provided at a transition region 40 located at the interface of a base region of an upper canopy and the upper region of a lower shelter portion supporting a continuous peripheral support element 20 and additionally incorporating a floor 91 and a base external suspension web 92, 100, 108, 110 extending from a base region of the fabric structure. Floor 91 is attached or attachable to, or bonded or mounted to, or otherwise associated with a base region of lower shelter portion 22 to provide a substantially closed or closable internal space. The floor may be reinforced in the region where an apical support structure contacts the floor, such as at a central portion of the floor structure.

Figure 10A:
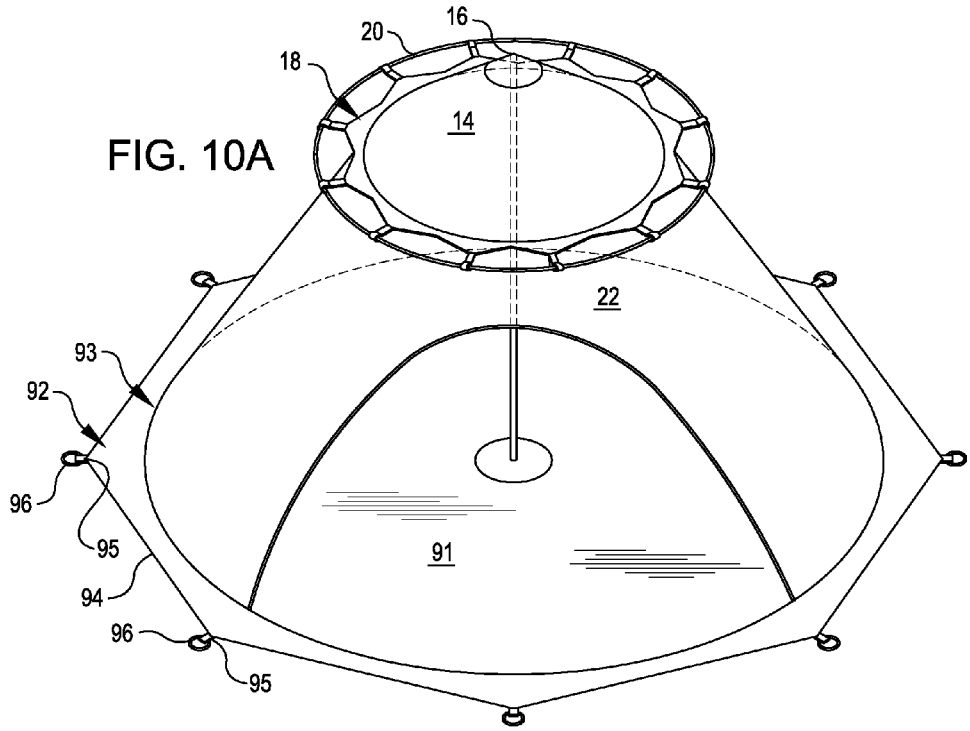
FIGS. 10A-10E show drawings schematically illustrating structures having an external suspension web provided at a transition region for supporting a peripheral support element and additionally incorporating an external suspension web extending from a base region of the structure.

FIG. 10A shows a structure having a generally round base configuration, with a base external suspension web 92 having a generally round internal edge mounted at a base transition region 93 formed at the intersection of the base of the shelter portion 22 and external suspension web 92. In this embodiment, base external suspension web 92 extends around the base perimeter of shelter portion 22 and has generally polygonal external edges 94 extending between points 95 positioned a distance from base transition region 93. In this embodiment, points 95 preferably circumscribe a circular form having a circumference larger than, and concentric with, the circumference of the base region of the fabric structure. Fixtures 96, such as rings, clips, fasteners, grommets, or the like, may be provided at or near points 95 for attaching stakes, guy lines, or the like, that may be used to provide balanced compressive resistance to the tensile forces emanating from the base transition region 93. Balanced radial forces transmitted through the suspension web to the base of the structure in a substantially uniform and/or symmetrical manner, as shown, impart improved tautness and stability to the walls of the structure.

Figure 10B:
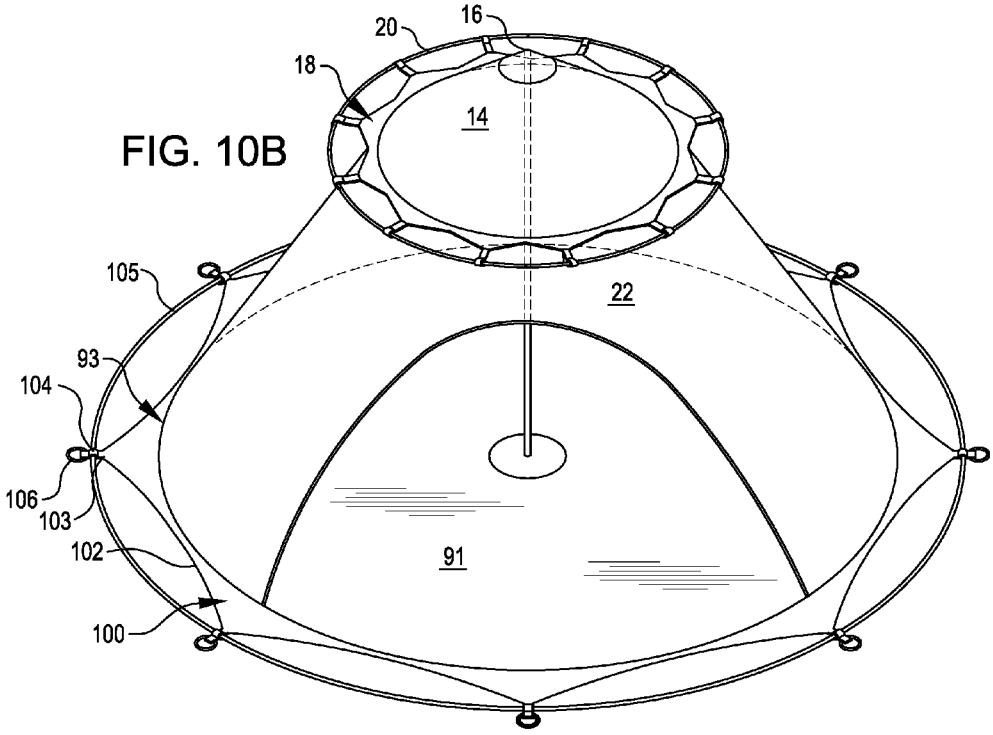

FIG. 10B shows a structure having an external base suspension web 100 positioned at a base transition region 93 formed at the intersection of the base of shelter portion 22 and external suspension web 100. In this embodiment, external suspension web 100 has generally inwardly curved external edges 102 extending between points 103 positioned a distance from base transition region 93. Clips 104 for attachment of a peripheral base support member 105 having a closed, continuous configuration are provided at or near points 103. Fixtures 106, such as rings, clips, fasteners, grommets, or the like, may optionally be provided at or near points 103 for attaching stakes, guy lines, or the like. Mounting a closed, continuous peripheral base support member on a base suspension web extending externally of the base of the structure desirably tensions the base of the structure and exerts forces radially through the base transition region 93 in a substantially uniform and/or symmetrical manner, and also facilitates the erection and use of such structures in applications where the use of stakes and guy lines is impossible or impractical.

Figure 10C:
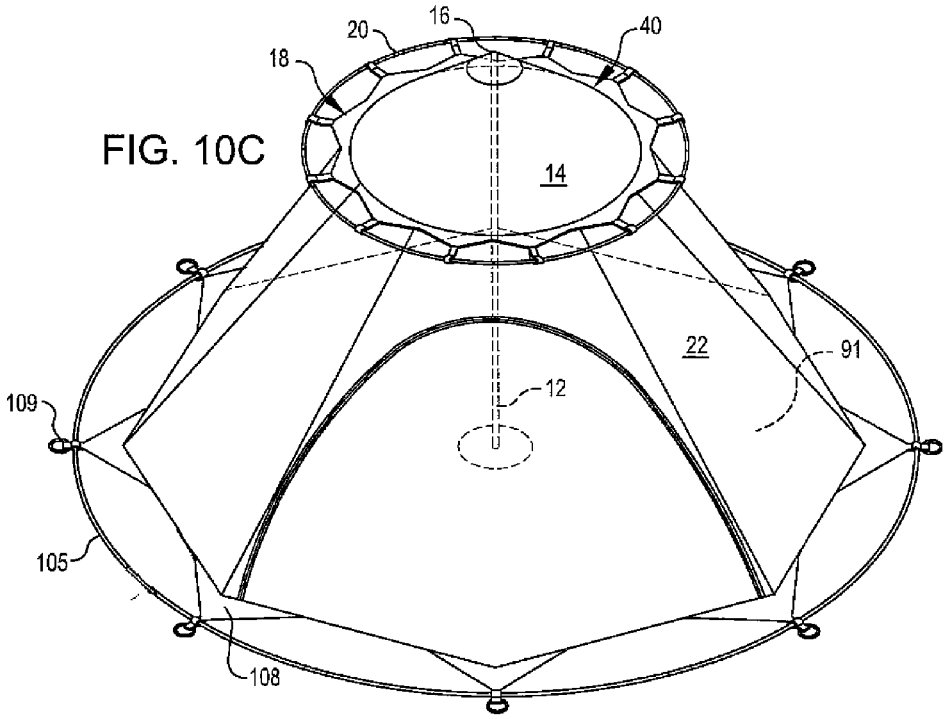

FIG. 10C illustrates a structure similar in some respects to that illustrated in FIGS. 10A and 10B, and having a base external suspension web provided in the form of a plurality of tabs 108 extending externally from perimeter regions of the base of lower shelter portion 22. In this embodiment, the base of lower shelter portion 22 has a polygonal configuration and tabs 108 extend externally from and are aligned with the corners of the base perimeter. Tabs 108 are illustrated as having a generally triangular configuration with a wider base portion aligned with corners of the base perimeter and a narrower portion extending externally of the base perimeter and forming a narrow external region or point. Clips for attachment of a peripheral base support member 105 having a closed, continuous configuration are provided at or near external points of tabs 108. Fixtures 109, such as rings, clips, fasteners, grommets, or the like, may optionally be provided for attaching stakes, guy lines, or the like. It will be appreciated that while a base suspension web in the form of a plurality of externally directed tabs is illustrated in FIG. 10C in combination with a lower shelter portion having a polygonal base configuration, the base external suspension web configurations described previously may also be used in combination with a lower shelter portion having a polygonal base configuration.

Figure 10D:
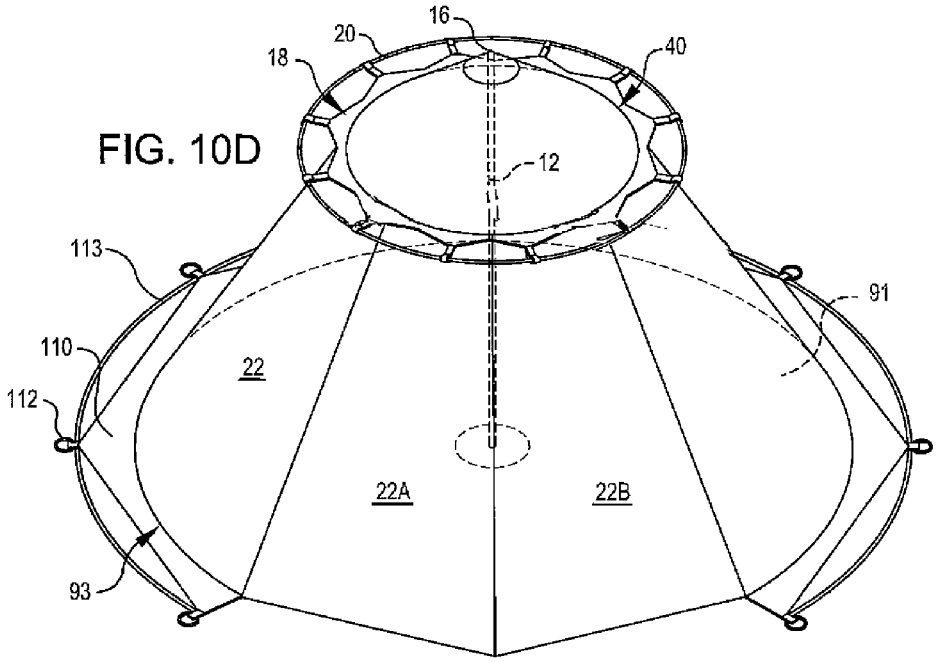

FIG. 10D schematically illustrates a structure of the present invention having a partially round base configuration and an external base suspension web 110 having a generally round internal edge extending partially around the base portion of the lower shelter portion at transition region 93. Clips for attachment of a peripheral base support member 113 having a continuous curved configuration in a partially circular form are provided at or near external points of base external suspension web 110. Fixtures, such as rings, clips, fasteners, grommets, or the like, may optionally additionally be provided for attaching stakes, guy lines, or the like. In this embodiment, external base suspension web 110 and peripheral base support member 113 extend along at least 50%, preferably at least 60%, more preferably at least 70%, and yet more preferably at least 75% or 80% of the perimeter of the base region of shelter portion 22. Suitable end caps or other types of fixtures may be provided for supporting and/or stabilizing terminal ends of peripheral base support member 113 with respect to the peripheral support member. Although the peripheral base support member and the external base suspension web extend for only a portion of the perimeter of the base region of the shelter structure, the forces exerted radially through the base transition region 93 are captured in a substantially uniform and/or symmetrical manner.

The configuration of the base of shelter portion 22 may be curved having a substantially uniform radius of curvature along the transition region 93 where external suspension web 110 and peripheral base support member 113 are mounted, and may have a different configuration, such as a polygonal configuration at the base of panels 22A, 22B, as shown. Panels 22A, 22B may, for example, form a polygonal base structure. Panels 22A, 22B are suitable for use, in whole or in part, as an entry opening or doorway or vent structure.

Figure 10E:
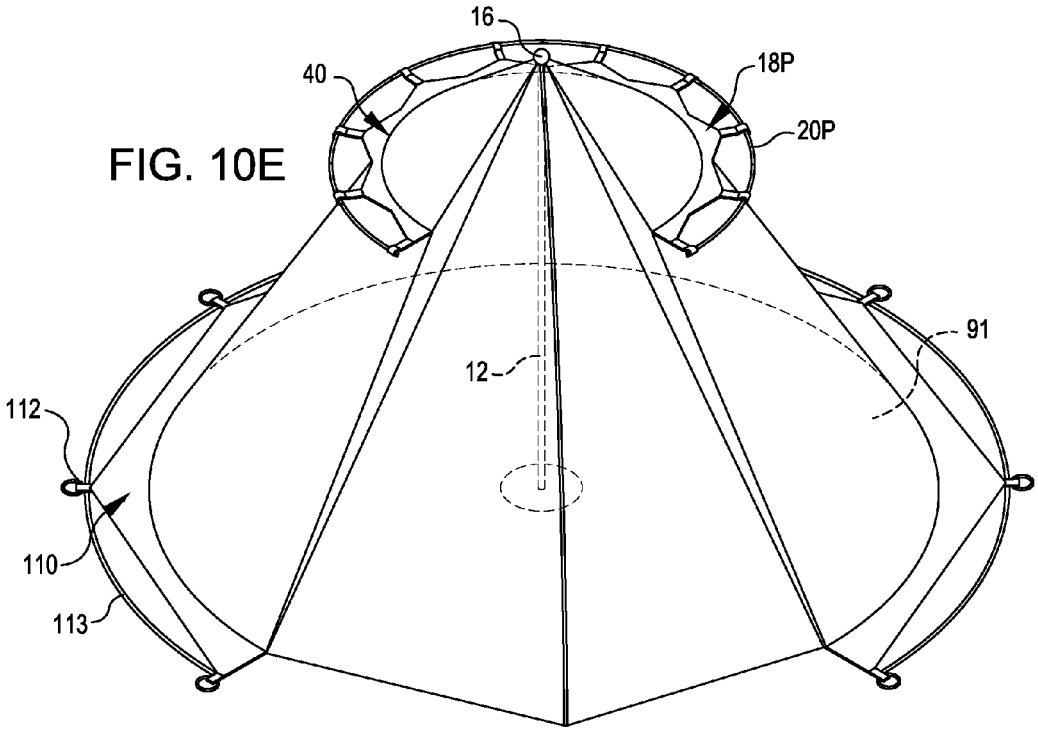

FIG. 10E illustrates an embodiment similar to that shown in FIG. 10D, in which both the peripheral base support member 113 and a transition region peripheral support member 20P have open, continuous curved configurations and extend partially along the path of base transition region 93 and upper transition region 40. In this embodiment, external base suspension web 110, peripheral base support member 113, upper peripheral suspension web 18P and transition region peripheral support member 20P extend along at least 50%, preferably at least 60%, more preferably at least 70%, and yet more preferably at least 75% or 80% of the perimeter of the base region of shelter portion 22. Suitable end caps or other types of fixtures may be provided for supporting and/or stabilizing terminal ends of peripheral base support member 113 and upper peripheral support member 20P. This embodiment provides a higher entry point and potentially more accessible internal space.

The externally directed base suspension web with attachment mechanisms for mounting an external base support member and/or for attachment of stakes, guy lines, or the like may be used in combination with structures of the present invention incorporating an external suspension web supporting a peripheral support element at or near a transition region located at the interface of an upper canopy portion and a lower shelter portion, as shown in FIGS. 10A-10E. An externally directed base suspension web with attachment mechanisms for mounting an external base support member and/or for attachment of stakes, guy lines, or the like, may also be used with other types of structures having curved or polygonal base regions that don't incorporate an externally directed suspension web or peripheral support member at a transition region between an upper canopy and lower shelter portion. It will be appreciated that externally directed suspension webs described for use at or near a transition region may be used at or near the base of a lower shelter portion of a structure as base suspension webs.

Figure 11A:
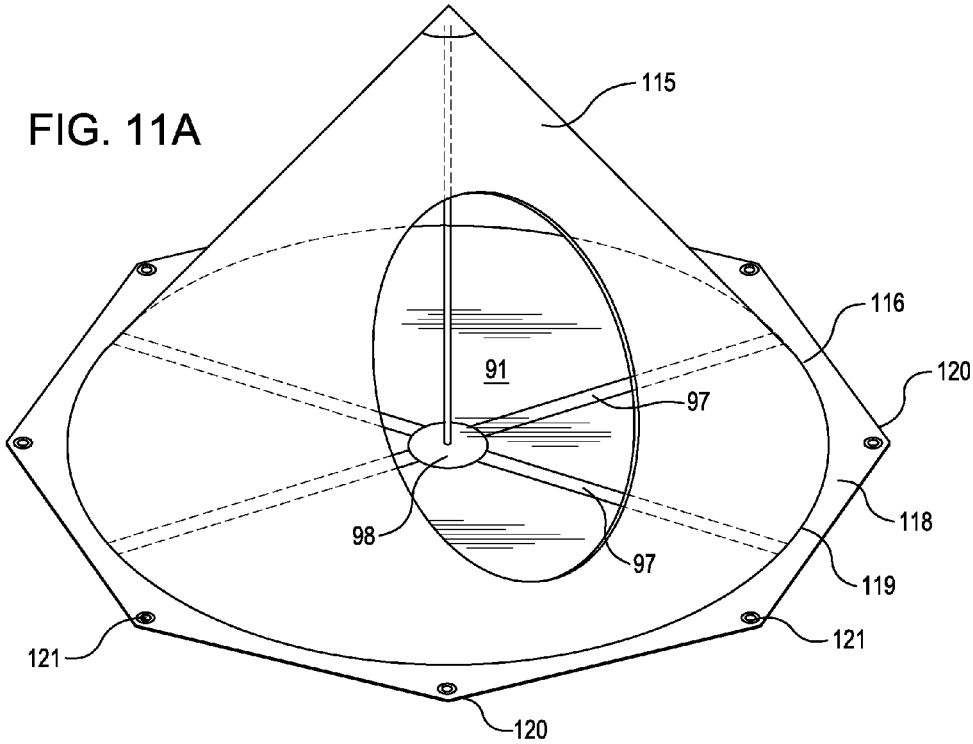
FIGS. 11A-11E show drawings schematically illustrating structures having different configurations and incorporating an external suspension web extending from a base region of the fabric structure.
Figure 11B:
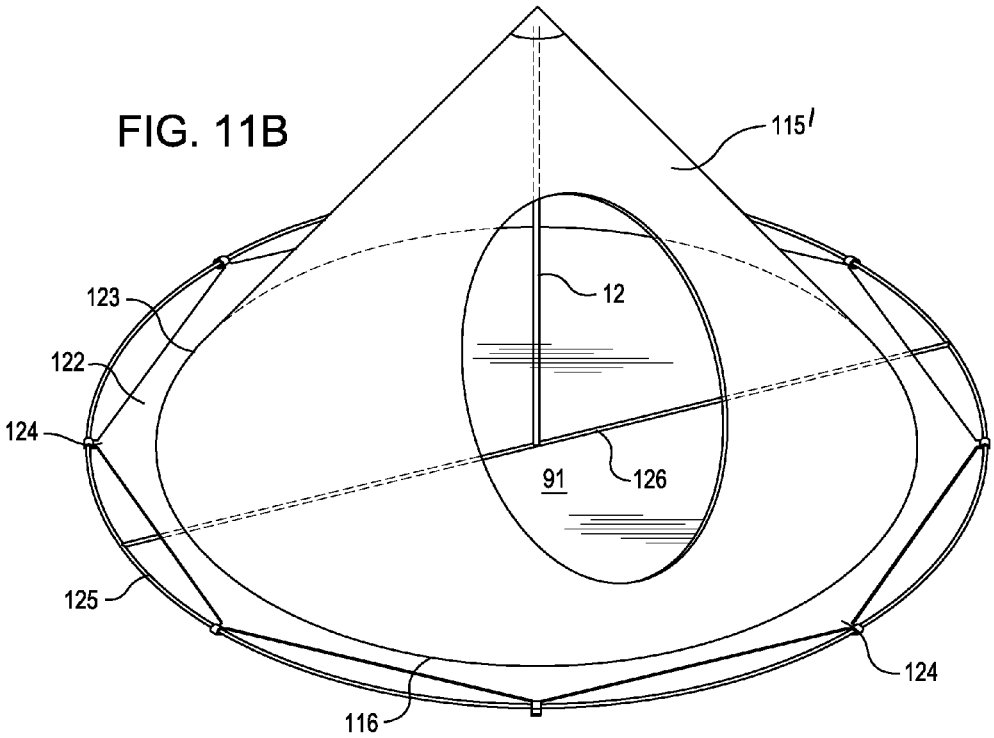

FIGS. 11A and 11B schematically illustrate shelter structures 115, 115' having generally conical configurations and generally curved, round base perimeters 116. Base suspension web 118 extends externally of base perimeter 116 and has a generally round internal edge 119 mounted at the base perimeter 116 of shelter structure 115. In this embodiment, base external suspension web 118 extends around the base perimeter of shelter structure 115 and has generally polygonal external edges extending between points 120 positioned a distance from base perimeter 116. Fixtures 121, such as rings, clips, fasteners, grommets, or the like, may be provided at or near points 120 for attaching stakes, guy lines, or the like, to provide balanced compressive resistance in a substantially uniform and/or symmetrical manner to the tensile forces traveling through the base suspension web and emanating from the base perimeter 116.

Shelter structure 115 additionally comprises a floor 91 attached or attachable to, or bonded or mounted to or otherwise associated with, a base region of shelter structure 115 to provide a substantially closed or close-able internal space. The floor may be reinforced in the region where an apical support structure contacts the floor, such as in a central portion of the floor. The floor 91 may also incorporate one or more reinforcing or stabilizing straps 97 radiating from a central region of the floor and, in the embodiment shown, essentially crossing one another at a center point of the floor structure. Reinforcing straps 97 may comprise a substantially non-stretch material, or a material that stretches in a direction other than radially (with respect to the central region of the floor), and thereby stabilizing the floor and the entire structure in its erect form.

A central mounting structure 98 may additionally be provided that is configured and arranged to engage and position a lower end of an internal apical support. Such an apical support mounting structure receiving a lower end of the internal apical support provides more stable mounting and longer term positioning of the internal apical support when the structure is erected and during its use. FIG. 11B illustrates a similar shelter structure 115' having a generally conical configuration, in which base suspension web 122 extends externally of base perimeter 116 and has a generally round internal edge 123 mounted at the base perimeter 116. In this embodiment, base external suspension web 122 extends around the base perimeter of shelter structure 115' and has external edges extending between points 124 positioned a distance from base perimeter 116. Fixtures such as clips, hooks, straps, fasteners, or the like, may be provided at or near points 124 for mounting a peripheral support element, such as closed, continuous ring 125 to provide balanced compressive resistance in a substantially uniform and/or symmetrical manner to the tensile forces traveling through the base suspension web and emanating from the base perimeter 116. Additional fixtures may be provided for attaching stakes, guy lines, or the like, to base suspension web 122.

In the embodiment shown in FIG. 11B, one or more cross member(s) 126 may be provided independently of or in conjunction with a structure floor 91. Cross member 126, as illustrated, is positioned to bisect shelter structure 115' and has terminal ends extending to and stably mountable on and/or abutting peripheral support ring 125. Cross members may be fabricated from substantially rigid materials, such as metallic materials, as well as from flexible and pliable materials having low or substantially no stretch characteristics, such as webbing and the like. An internal mounting structure may additionally be provided that is configured and arranged to engage and stabilize a lower end of an internal apical support.

It will be appreciated that when an attached floor and/or reinforcing webbing are used as illustrated schematically in FIG. 11A or cross members are used as illustrated schematically in FIG. 11B, in combination with an apical support mounting structure, an internal apical support member, an external base suspension web and a peripheral support member as in FIG. 11B, the shelter structure becomes a freestanding moveable structure that can be erected absent any contact with the ground and can be transported or relocated in an assembled form.

Figure 11C:
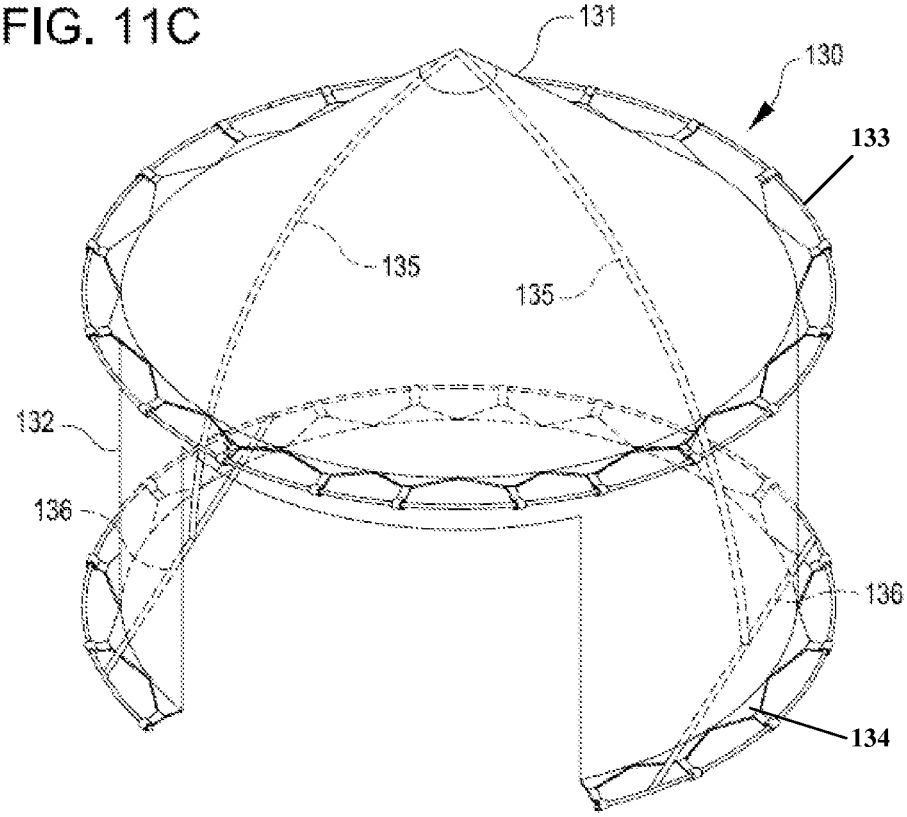

FIG. 11C illustrates another embodiment of a shelter structure 130 suitable for use, for example, as an exhibition structure and having a generally conical upper canopy portion 131 and a lower shelter portion 132 that meet at a transition region. An external suspension web extends externally of the transition region and supports a transition region peripheral suspension member 133 having a generally circular configuration. A base suspension web extends partially around the base of lower shelter portion 132 and supports a peripheral base suspension member 134 extending partially around the base of lower shelter portion 132. A relatively large entry or door is provided in the area that is not traversed by the base suspension web and the peripheral base suspension member.

Shelter structure 130 additionally comprises an internal apical support structure provided by two (or more) curved internal apical supports 135 having one end mounted at or near an apex of the shelter structure and another end terminating at or near a base portion of the shelter structure. The base ends of the internal apical supports may be supported by the ground or a base support, or by a floor structure. Alternatively or additionally, base ends of internal apical supports may be supported by cross-bars 136 that mount to or are supported by a peripheral base suspension member 134, as shown. Shelter configurations adopting multiple internal apical supports positioned away from the central portion of the structure provide a large internal volume that is substantially uninterrupted and may be used for various applications, including fabric tents, other types of fabric structures, exhibition structures, transient housing and other types of structures It will be appreciated that when multiple internal apical supports with base ends attached directly to a peripheral base support member or to cross-bars mounted to a peripheral base support member are used in combination with an external base suspension web as in FIG. 11C, the shelter structure becomes a freestanding moveable structure that can be erected absent any contact with the ground and can be transported or relocated in an assembled form.

Figure 11D:
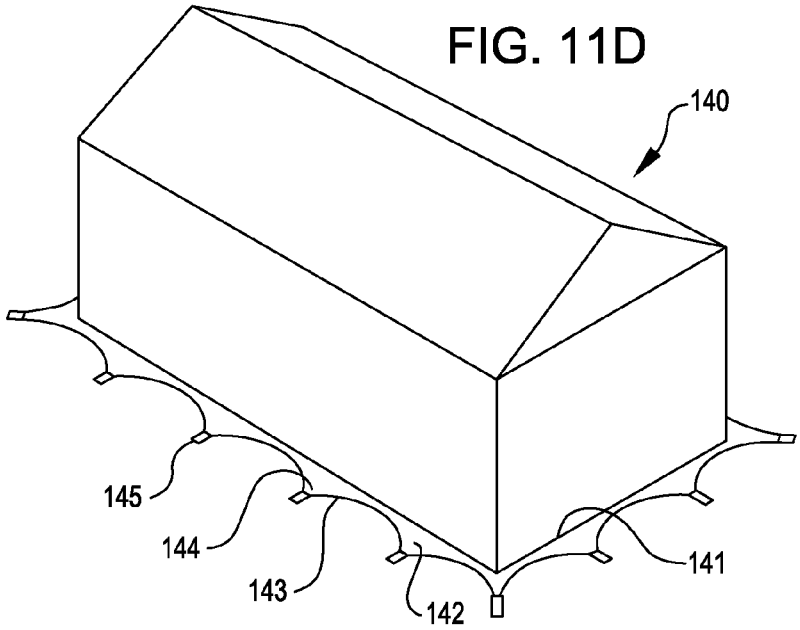
Figure 11E:
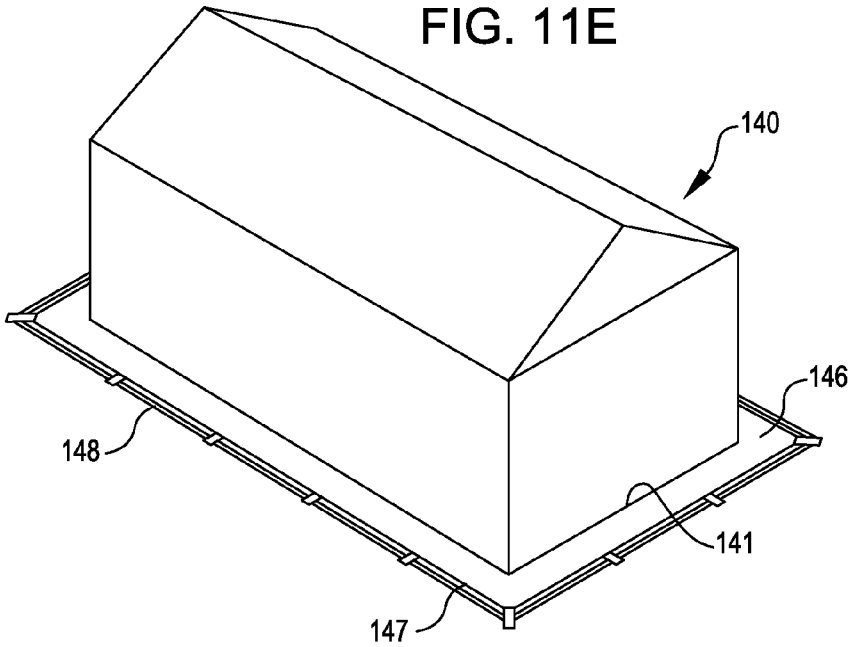

FIGS. 11D and 11E illustrate the use of base suspension webs with structures having a polygonal (e.g., rectangular) base configuration. In the embodiment illustrated in FIG. 11D, base suspension web 142 extends externally of rectangular base perimeter 141 of a generally box-shaped structure 140 and has a generally rectangular internal edge mounted at the base perimeter 141 of the shelter structure. In this embodiment, base external suspension web 142 has curved external edges 143 extending between points 144 positioned at intervals along the perimeter, a distance from base perimeter 141. Points 144 are located extending radially from each corner of a polygonal structure and, in many embodiments, additional points extend from the base suspension web at regularly spaced intervals between corners, as shown. Fixtures 145, such as rings, clips, fasteners, grommets, tabs, or the like, may be provided at or near points 144 for attaching stakes, guy lines, or the like, to provide balanced compressive resistance in a substantially uniform and/or symmetrical manner to the tensile forces traveling through the base suspension web and emanating from the rectangular base perimeter 141.

FIG. 11E illustrates an embodiment in which base suspension web 146 extends externally of rectangular base perimeter 141 of a generally box-shaped fabric structure 140 and has a generally rectangular internal edge mounted at the base perimeter 141 of the shelter structure. In this embodiment, base external suspension web 146 has a generally rectangular external edge 147 extending externally around rectangular base perimeter 141 and positioned a distance from base perimeter 141. Fixtures such as clips, hooks, straps, fasteners, or the like, may be provided at or near corner locations extending radially from each corner of the polygonal structure and, additionally, at positions between corner locations in a generally regular, as shown. Fixtures such as rings, clips, fasteners, grommets, tabs, or the like may alternatively or additionally be provided for mounting a peripheral support element, such as closed, continuous rectangular rod 148 extending around the periphery of external edge 141 of base external suspension web 146. Additional fixtures may be provided for attaching stakes, guy lines, or the like. The use of base suspension web 146 to mount a peripheral support element 148 and/or external supporting mechanisms such as stakes, guy lines, cables, or the like, desirably exerts forces outwardly from the polygonal base perimeter 141 in a substantially uniform and/or symmetrical manner.

Figure 12:
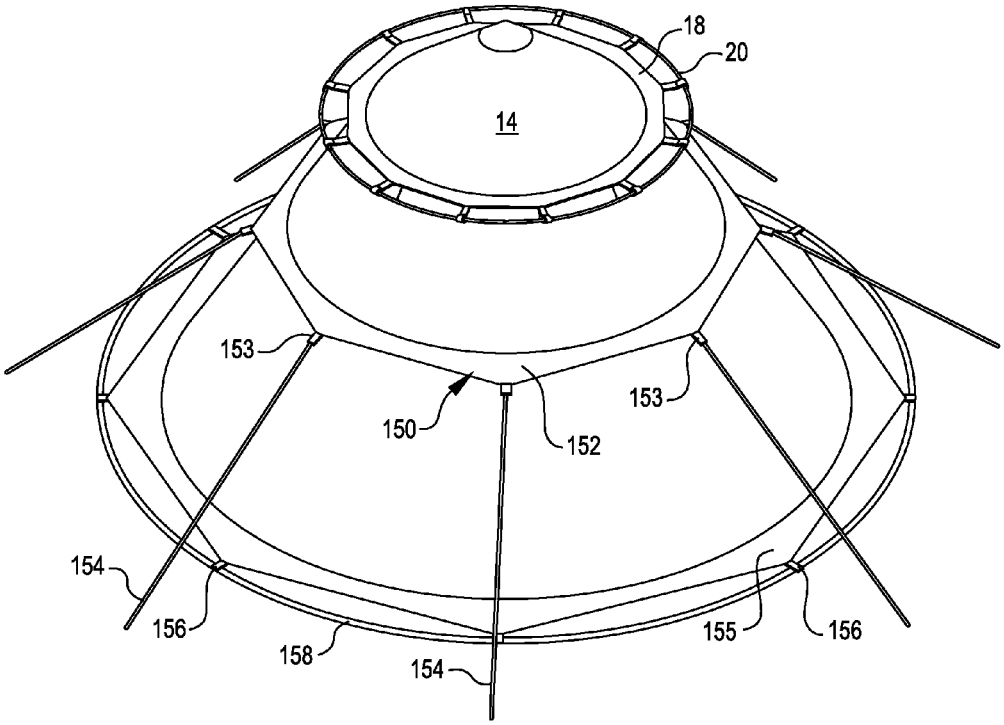
FIG. 12 shows a drawing schematically illustrating the use of an external suspension web extending externally of an intermediate region of a fabric structure located above the base region.

FIG. 12 illustrates another embodiment of shelter structures of the present invention in which an external suspension web 150 is mounted extending externally of the structure intermediate an upper transition region and a base perimeter region. In this exemplary embodiment, intermediate external suspension web 150 has a continuous internal edge extending around the perimeter of the structure having a size and configuration that matches the size and configuration of a perimeter of the shelter structure at the location of the intermediate external suspension web. A plurality of extending portions or tabs 153 are provided for supporting fixtures such as rings, clips, hooks, anchors, straps, buckles, loops, fasteners, grommets, or other types of attachment mechanisms for attaching stakes, guy lines, or the like to the intermediate external suspension web, and/or for mounting an external peripheral support element to the intermediate external suspension web. It will be appreciated that alternative embodiments of suspension webs disclosed herein may also be employed as intermediate external suspension webs.

An intermediate external suspension web 150 may be used alone to exert forces outwardly from an intermediate region of the structure in a substantially uniform and/or symmetrical manner, but it is often employed in combination with an external suspension web 18 and peripheral support element 20 extending externally of a transition region at the interface of upper canopy portion and a lower shelter portion. In this embodiment, the intermediate external suspension web 150 may support a second continuous or partial peripheral element and/or fixtures for supporting stakes, guy lines, cables, or the like, exerting forces outwardly from the shelter structure in a substantially uniform and/or symmetrical manner. An intermediate external suspension web 150 may provide additional support and structural stability in harsh weather conditions, and may also be used to shape the external shelter profile and the internal volume.

Structures employing an intermediate external suspension web may (optionally) additionally incorporate a base suspension web 155 having fixtures 156 for retaining a base peripheral support element 158, as shown in FIG. 12. And, while FIG. 12 illustrates the use of an external suspension web at an intermediate region of the enclosure structure in combination with multiple other external suspension webs and peripheral support elements, it will be appreciated that providing one or more external suspension web(s) at an intermediate region of an enclosure structure may be advantageous in fabric structures having a variety of configurations and profiles to shape the enclosure portion, or at least a portion of it, to provide a substantially uniform distribution of forces, and/or to provide a pre-defined base footprint. It will also be appreciated that the base of an enclosure portion may be anchored to the ground or to a platform or another stable support using stakes, anchors, lines, cables, guy wires, or the like.

The structures described herein may be fabricated from pliable fabrics, including various types of sheet materials, as well as from semi-rigid and substantially rigid panel materials. In general, it is preferred to fabricate structures from materials having generally low-stretch and/or isotropic stretch properties. For applications where the portions of structures may be fabricated from multiple panels of woven fabric or other flexible materials having variable stretch characteristics, it may be desirable to more evenly distribute loads by stabilizing seams (e.g., seams joining adjacent panels, transition seams between upper shelter portions and lower enclosure portions, and in other locations) that are under tension when the structure is erected. Seam stabilization may be provided in a variety of ways, such as by providing a substantially non-stretch (or lower stretch) material sewn into, or bonded to, or otherwise attached to the underlying material at or near seam locations, or by providing reinforcing panels comprising materials having different stretch characteristics or stretch profiles along different directions at seam locations and/or at other panel locations. More generally, providing seams, interfaces and/or stabilizing panels composed of at least one material having lower (or different) stretch characteristics than other materials being joined, is useful for many types of tent and fabric structure applications. This stabilization helps to distribute the tensile forces and control the stretch or strain exerted on the fabric structures at desired locations.

Figure 13A:
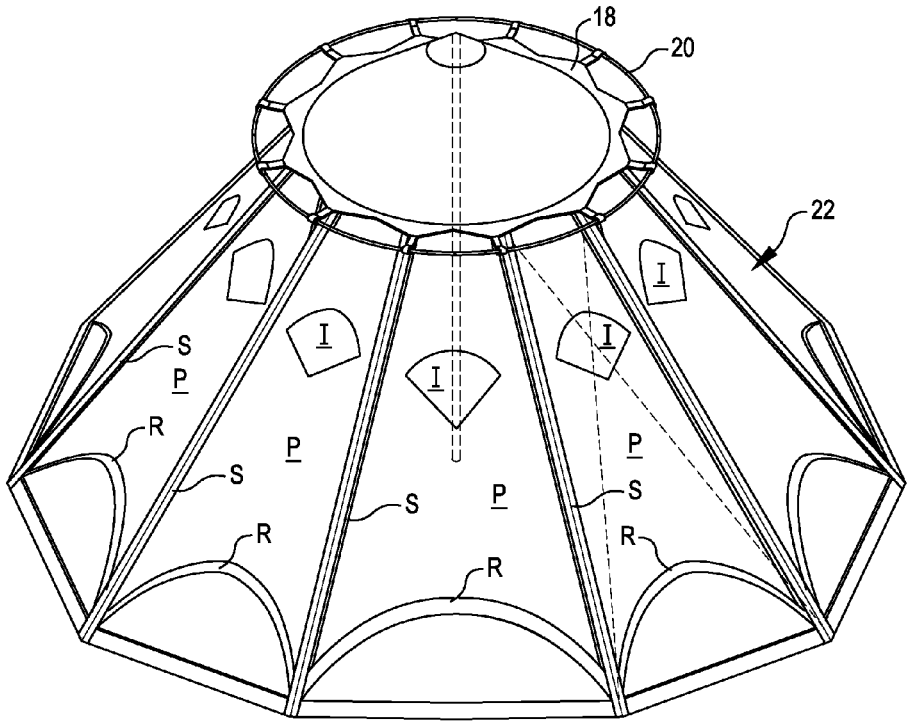
FIGS. 13A and 13B show schematic drawings from an upper perspective view of the exterior assembled structures in the form of tents having various stabilization features.
Figure 13B:
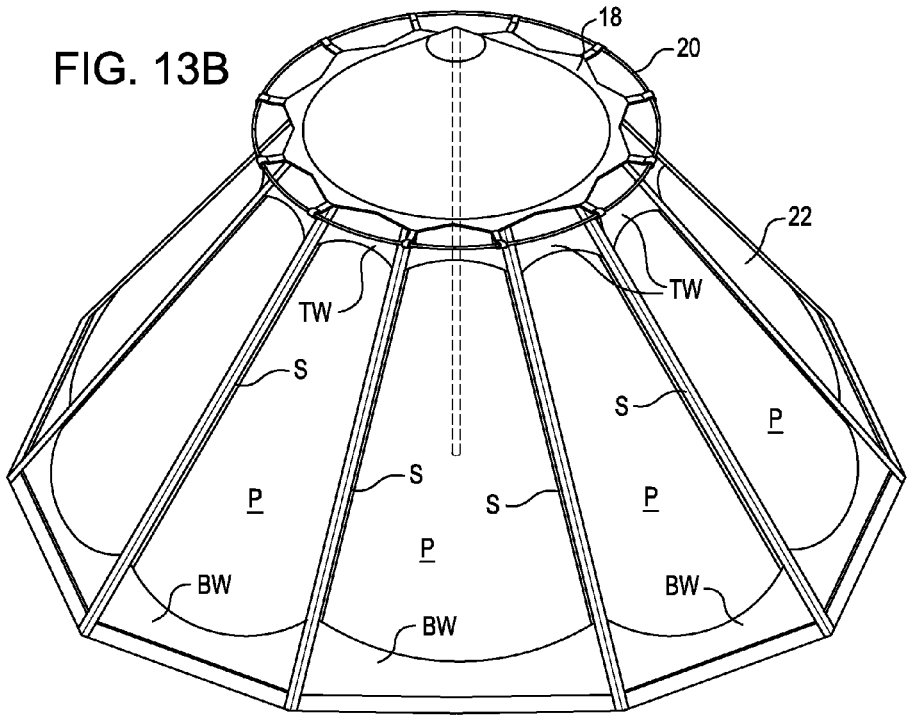

FIGS. 13A and 13B schematically show stabilizing strips S provided at the seams joining adjacent pliable fabric panels P of the lower shelter structure 22. Stabilizing strips S are generally fabricated from a material having different stretch characteristics (e.g., lower stretch characteristics, stretch characteristics in different directions, etc.) than pliable fabric forming panels P. Stabilizing strips S may be provided as an integral part of the seam, e.g. sewn into or bonded to panel edges forming the seam, or they may be provided overlying and bonded to the seam, or near the seam, on the external and/or internal surface(s) of panels P. Stabilizing strips S preferably extend for the full length of each panel seam.

FIG. 13A illustrates another feature of the present invention in which curved bands R are provided in proximity to the base of panels P of lower shelter portion 22 to stabilize the tensile forces exerted in the region of the base of the lower shelter portion. Curved stabilizing bands R are fabricated from a material having different stretch characteristics (e.g., lower stretch characteristics, stretch characteristics in different directions, etc.) than the material forming pliable fabric panels P. In the embodiment shown in FIG. 13A, curved stabilizing bands R are mounted to the panels as curved segments having end regions positioned near the panel edges in proximity to panel seams and having the curved portion extending away from the lower panel edge between the panel seams. This type of stabilization may additionally or alternatively be provided on panels of the enclosure portion and/or the shelter portion in the area of the transition seam. Curved bands may be provided, for example, at the upper portion of lower enclosure panels and/or at the lower portion of the upper shelter portion in the area of the transition seam, with the band ends positioned at or near the transition seam and curved segments in each case extending away from the transition seam.

FIG. 13A also illustrates the use of stabilizing fabric inserts I fabricated from fabric having lower or different stretch properties from the material forming pliable fabric panels P. In the embodiment shown in FIG. 13A, stabilizing inserts I are mounted to panels P as fan-shaped segments positioned in intermediate areas with respect to panel edges. In some embodiments, inserts I are positioned at a location of panels P where lines joining opposite corners of the panels intersect, as shown in dashed lines in one of the panels P shown in FIG. 13A.

In some embodiments, stabilization of fabric structures and improved distribution of tensile forces may be provided by employing webs at circumferential locations where it is desirable to have evenly distributed tensile forces, such as at transition regions (e.g., between the upper shelter section and the lower enclosure section). In the embodiment shown in FIG. 13B, stabilizing strips S are provided at or in conjunction with seams joining adjacent pliable fabric panels P of the lower shelter structure 22. In this embodiment, a base web BW comprising a substantially non-stretchy material may be provided and sewn, bonded or otherwise attached to the underlying structural material (e.g., fabric) at locations in proximity to the base of the structure. A transition web TW comprising a substantially non-stretchy material may be provided and sewn, bonded or otherwise attached to the underlying structural material at locations in proximity to the transition region at the interface of an upper canopy portion and a lower shelter portion. Base webs BW and transition webs TW may comprise a plurality of curved or triangular sections having points or extensions extending from a continuous web or band of material, similar in configuration to the suspension webs described above. The points or extensions of base webs BW and transition webs TW are preferably aligned with the seams of the lower shelter portion to provide more uniform and/or symmetrical distribution of tensile forces around the perimeter at the transition region and/or the base region of the fabric structure and to reduce undesired stretching of fabric at the transition and base regions of the structure.

Figure 14A:
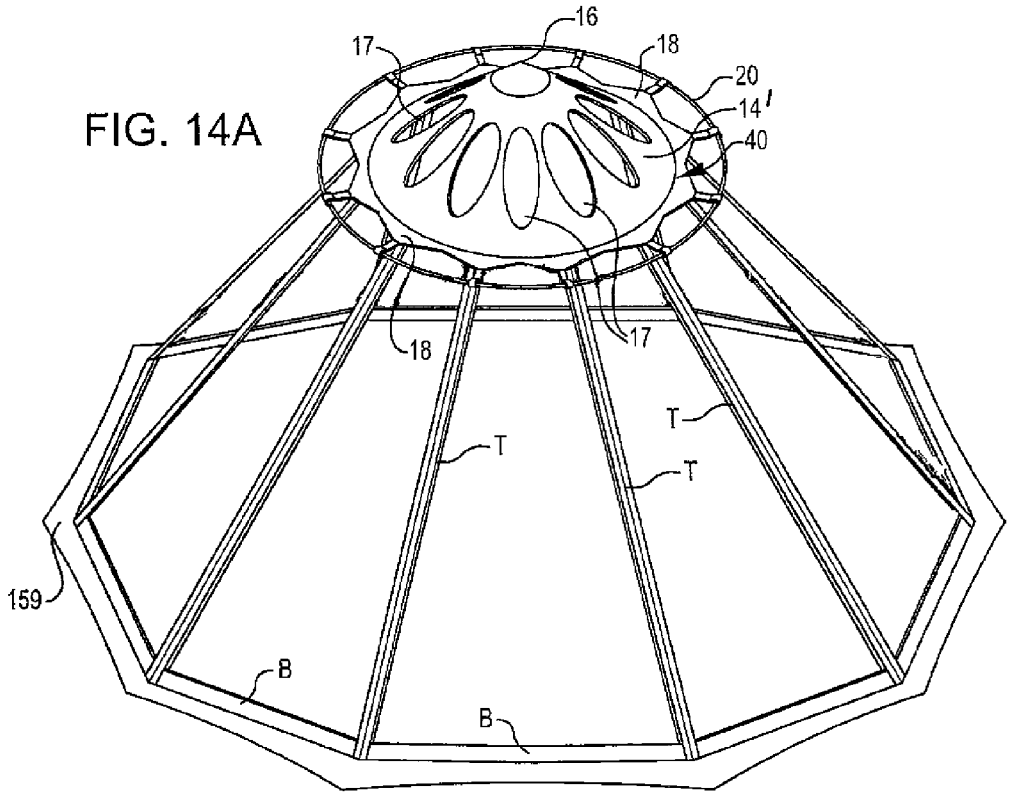
FIGS. 14A and 14B show schematic drawings illustrating different skeletal structural embodiments comprising an upper shelter portion having an apex, an external peripheral suspension web and peripheral support element at the transition region.
Figure 14B:
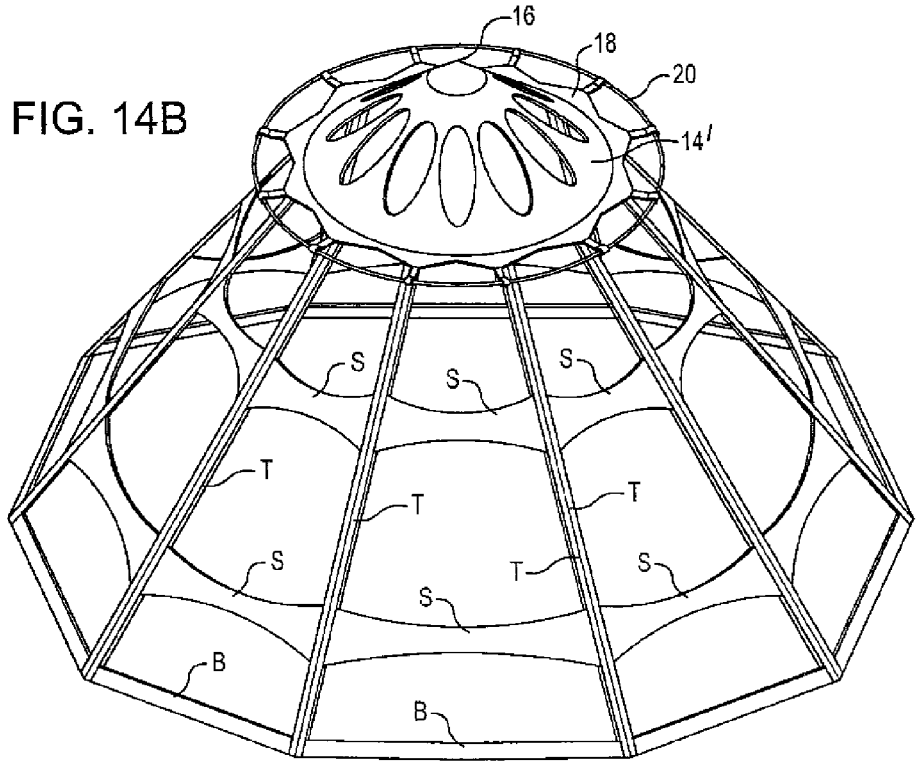

FIGS. 14A and 14B illustrate "skeletal" embodiments of structures of the present invention in which the upper shelter portion 14' has a central apex 16 and comprises a plurality of openings 17 provided between the central apex 16 and transition region 40 where the external suspension web 18 supports peripheral support element 20. Openings 17 may be generally oval as shown, or may be provided in other configurations, and different numbers and sizes of openings may be provided. In alternative embodiments, upper shelter portion 14' may comprise a plurality of flexible, strap- or band-like members extending between the apex or an area in proximity to the apex and the transition region 40 and external suspension web 18. In this embodiment, strap- or band-like members may have enlarged areas where they approach or interface with a reinforced apical section and/or with the external suspension web 18. This provides a flexible, lightweight, high strength upper canopy structure that, when erected, is held in tension by an apical support member in combination with peripheral support member 20.

In the skeletal structural embodiments shown in FIGS. 14A and 14B, a lower framework structure takes the place of the lower enclosure portion previously described. The lower framework structure is connected, directly or indirectly, to the upper shelter portion 14' and/or to external suspension web 18. The lower framework structure, in the embodiment illustrated in FIG. 14A, preferably comprises a transition web similar to that shown in FIG. 13B (not visible in FIG. 14A) connected, directly or indirectly, to external suspension web 18 and extending below the transition region, a plurality of tendons T extending from the transition web in a direction away from external suspension web 18, and lower peripheral bands B extending between the lower termini of tendons T and forming a peripheral base portion. The framework structure may additionally include a base external suspension web 159 as shown and as previously described and shown. The components of the skeletal structure are preferably fabricated from materials having pliable, low-stretch characteristics, and/or uniform stretch characteristics, or from materials that are substantially non-stretchy, such as webbing, cables, flexible high strength plastics, thermoplastic materials, reinforced non-woven materials, and the like. Additional stabilization features may optionally be provided, as described above.

FIG. 14 B illustrates an alternative embodiment of a lower framework structure that takes the place of the lower enclosure portion described previously. The lower framework structure, in this exemplary embodiment, comprises a transition web similar to that shown in FIG. 13B (not visible in FIG. 14B) connected, directly or indirectly, to external suspension web 18 and extending below the transition region, a plurality of tendons T extending from the transition web in a direction away from external suspension web 18, and one or more intermediate stabilizing webs S extending laterally between tendons T around the periphery of the structure. Intermediate stabilizing webs S preferably have low or non-stretch characteristics along their longitudinal axes (extending from tendon to tendon) and may have reciprocally curved edges, as shown, in a catenary curved or hour-glass shaped configuration.

A lower peripheral band B may be provided extending between tendons T and forming a peripheral base portion. Intermediate stabilizing bands S may be provided at more than one location between the transition region and the base of the structure, as shown. The framework structure may additionally include a base external suspension web as previously described and shown. The components of this skeletal structure are preferably fabricated from materials having pliable, low-stretch characteristics, and/or uniform stretch characteristics, or from materials that are substantially non-stretchy. The skeletal structures illustrated schematically in FIGS. 14A and 14B may additionally comprise material, such as a lightweight fabric, mesh, or another pliable sheet material, sewn or bonded to the skeletal framework to wholly or partially cover open areas and provide a partially or completely enclosed structure.

Alternatively or additionally, skeletal structures such as those shown in FIGS. 14A and 14B may be used substantially as shown as a framework for supporting a full or partial covering for providing a partially or fully enclosed structure. Coverings having translucent or transparent properties, or fabricated partially or entirely of screen or mesh materials may be provided. Skeletal structures employed in combination with full or partial coverings may be particularly suitable for use as lightweight canopies, tents and enclosures, as well as for temporary or semi-permanent and movable shelters used for disaster relief and humanitarian purposes or in other situations where climate-appropriate flexible sheet material is readily available. These types of skeletal structures, used in combination with a variety of coverings providing fully or partially enclosed structures, may also provide exhibition structures, aviaries, greenhouses, and other special purpose structures, depending on the type and extent of covering provided.

Figure 15A:
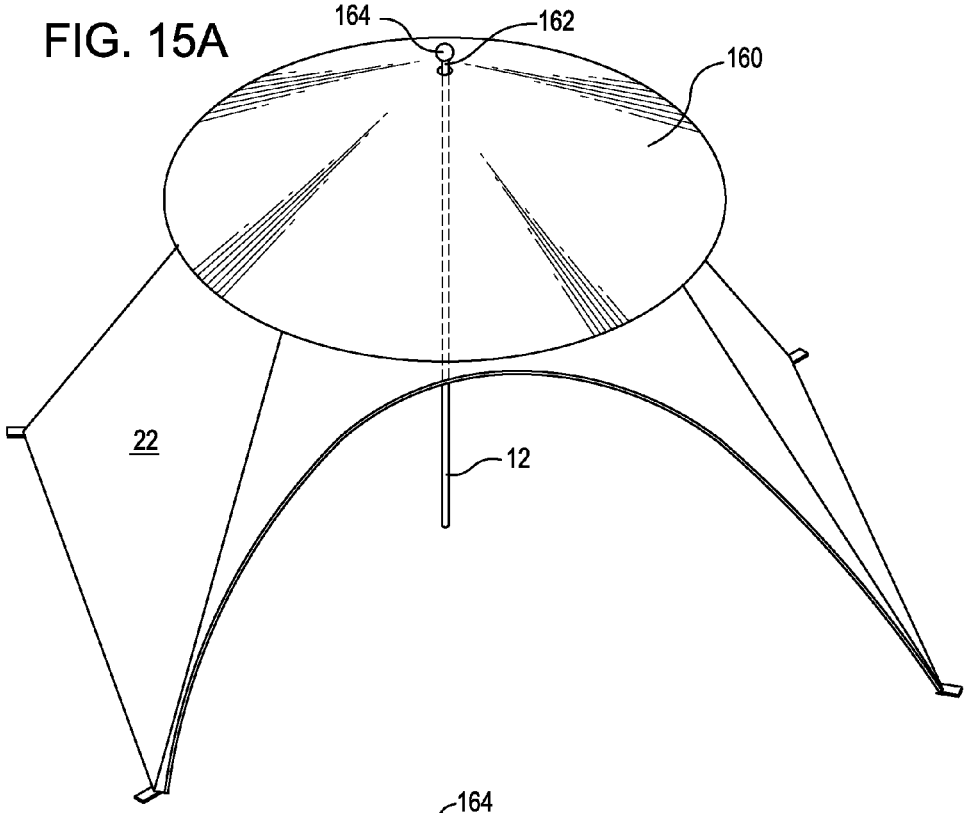
FIGS. 15A-15C show schematic drawings illustrating a partial fly structure mounted over the upper canopy portion of a fabric structure, with FIG. 15A showing the outer contours of the structure with the partial fly structure in place and FIGS. 15B and 15C illustrating one example of how the fly structure could interact with the external ring and the lower enclosure for stable mounting.
Figure 15B:
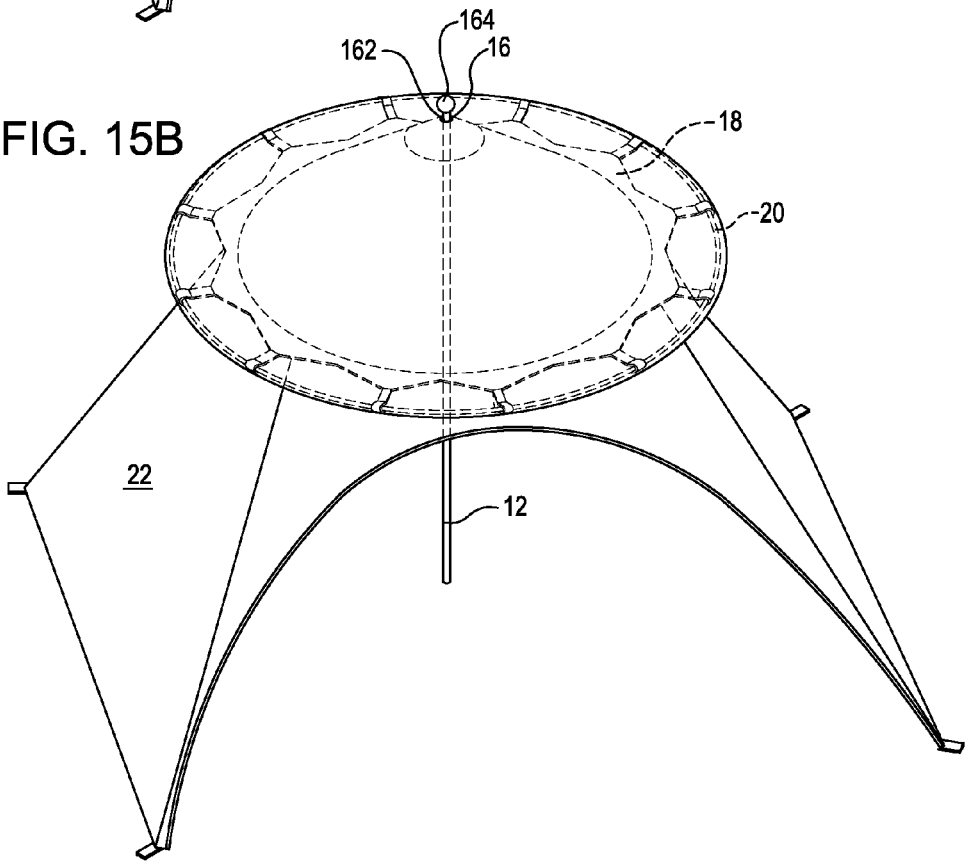
Figure 15C:
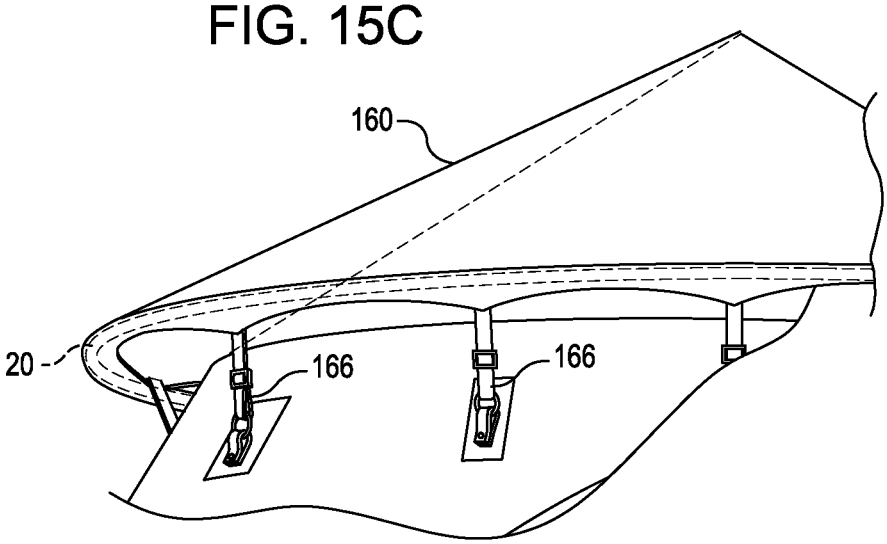

FIGS. 15A-15C illustrate one exemplary embodiment in which a covering structure, or fly, is mounted over the upper canopy portion of a structure of the present invention. In the embodiment illustrated, the canopy fly 160 is a generally conically-shaped structure supported at an apex of the underlying structure and extending to and over the peripheral support element 20. The canopy fly is preferably configured and arranged to preserve an air space between the upper canopy portion of the structure and the canopy fly when the fly is installed and during use of the fly.

An apex of canopy fly 160 may be reinforced where it interfaces with the apex of the underlying canopy structure and, directly or indirectly, with an internal or external apical support structure. When an internal apical support structure 12 is used, for example, an upper terminal end 162 of internal apical support structure 12 may be received through and penetrate suitable fittings provided at the apex of the upper canopy portion of the structure, as well as at the apex of the canopy fly. In this embodiment, a mating cap 164 may be mounted to the terminal end of the internal apical support after the canopy fly is positioned over the underlying canopy portion to securely position and retain the apex of the canopy fly in place. When an external apical support structure is used, the apex of the upper canopy portion and the canopy fly may be attachable to one another and mutually supported by the external support structure.

In one embodiment shown schematically in FIG. 15C, canopy fly 160, when mounted over the upper canopy portion of the underlying structure, extends around peripheral support element 20 and extending straps 166 fasten to the lower shelter portion at intervals spaced around the perimeter of the lower shelter portion below the transition region and external suspension web. In alternative embodiments, a canopy fly may extend around and over peripheral support element 20 and fasten to or be supported by the external suspension web, the peripheral support element, and/or be fastened at the transition region, thereby suspending the fly over the lower shelter portion to ensure that an appropriate air space is maintained between the fly and the lower shelter portion.

Figure 16A:
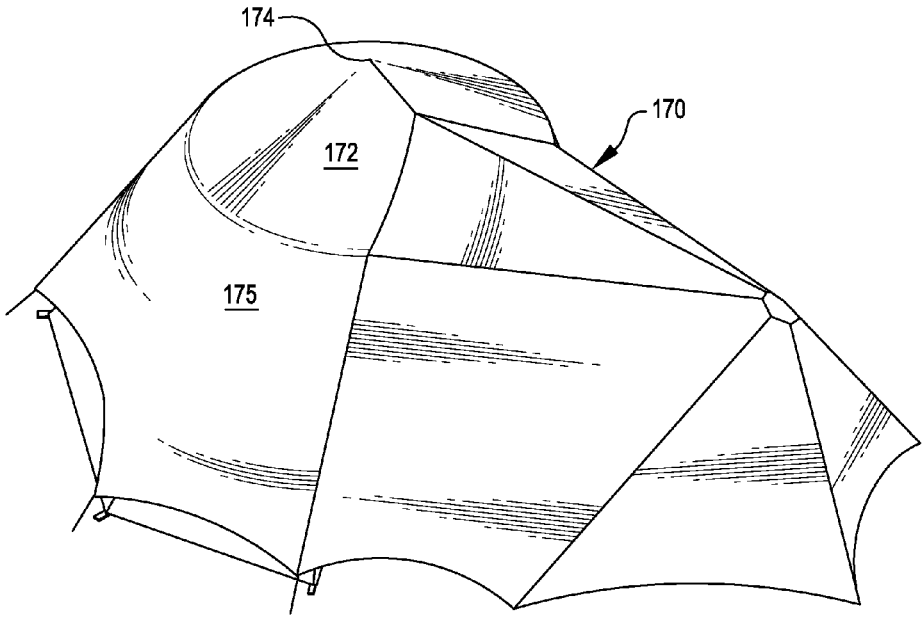
FIGS. 16A and 16B show schematic drawings illustrating an exemplary full fly structure, including a vestibule, mounted over a fabric structure of the present invention.
Figure 16B:
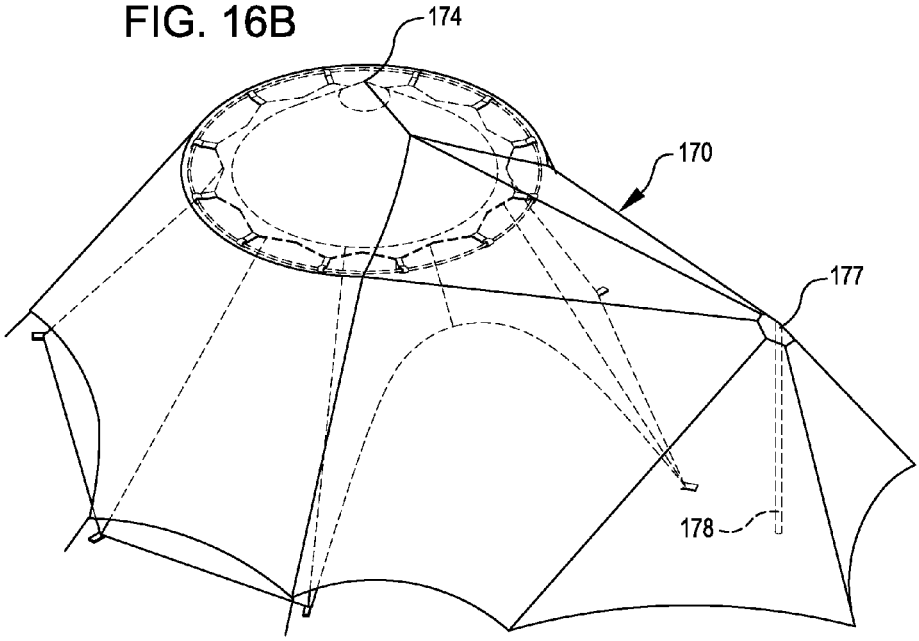

FIGS. 16A and 16B schematically illustrate an exemplary embodiment of a structure of the present invention in which a covering structure, or fly, is mounted and extends over substantially the entire underlying structure. In this embodiment, fly 170 incorporates an upper canopy portion 172 having an apex 174 configured and positioned to overly an underlying apex of the underlying structure. Upper canopy portion 172 has a configuration similar to the configuration of the underlying canopy portion and is positioned and spaced a distance from the corresponding underlying structure. Sidewalls 175 of the fly structure are similarly positioned and configured to be spaced a distance from the corresponding underlying lower shelter portion. In the embodiment illustrated in FIGS. 16A and 16B, fly 170 additionally incorporates a vestibule structure 176 that extends from the underlying structure in the region of the door. The vestibule structure 176 may be supported at a second, lower apex 177 by a second apical support structure 178, such as a tent pole or rod. Doors, windows, vents, and the like may be provided in the fly structure, as is well known in the art. In one embodiment, the underlying structure shown in FIGS. 16A and 16B may comprise, at least in part, a skeletal structure or a wholly or partially screened structure protected or protectable from the elements by the overlying fly.

Figure 17:
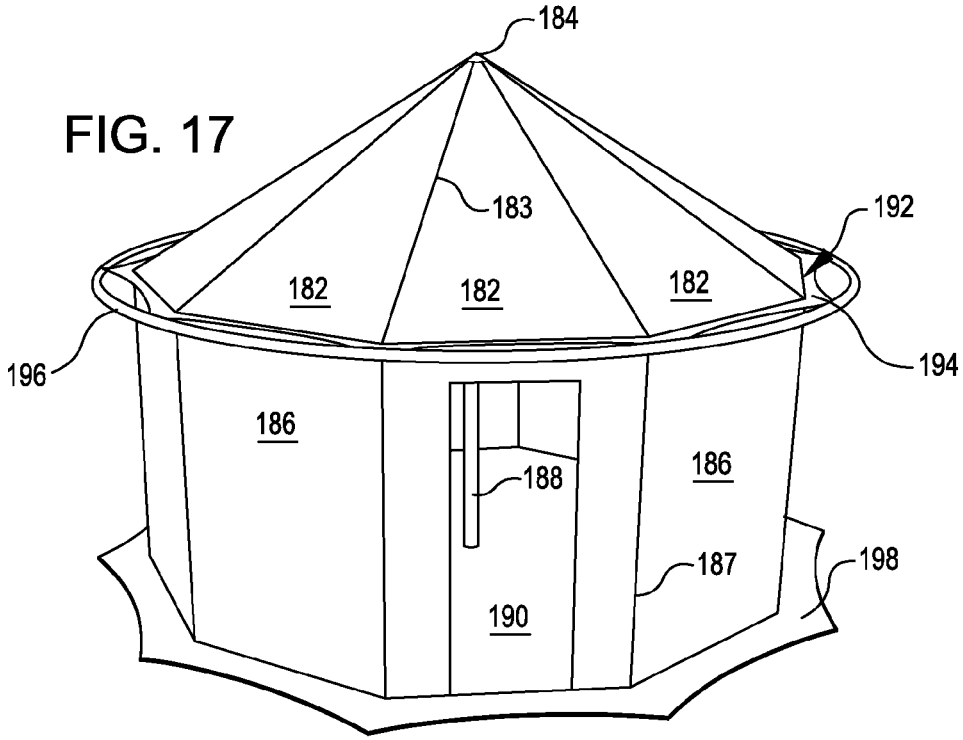
FIG. 17 shows a schematic diagram illustrating a structure of the present invention having an upper canopy portion and a lower shelter portion composed of panels incorporating a rigid or semi-rigid material joined to one another at flexible seams and having external support webs provided at both transition and base regions of the structure.

FIG. 17 illustrates a "panelized" structure 180 of the present invention comprising an upper canopy portion composed of a plurality of canopy panels 182 joined to one another at interfaces 183 and forming a conical structure having a central apex 184. A lower enclosure portion is composed of a plurality of sidewall panels 186 joined to one another at interfaces 187 and forming a generally polygonal configuration arranged symmetrically with respect to a central apical support 188. The upper canopy portion and lower enclosure portion interface at a polygonal transition region 192. A floor 190 may be mounted or mountable to a base region of sidewall panels 186 forming the lower enclosure portion.

Canopy panels 182 and sidewall panels 186 may be fabricated in a variety of ways, depending on the desired structural and functional attributes, the application, the location, etc. In one exemplary embodiment, rigid or semi-rigid canopy and/or sidewall panels joined or joinable to one another at flexible interfaces may be used. In this embodiment, the panels or subsets of panels forming the canopy and sidewalls may be foldable with respect to one another for shipping, transport and/or storage. One example of substantially rigid panels mounted to one another at flexible interfaces to provide folding panels is shown, in a portable boat application, in U.S. Pat. No. 5,524,570. In another embodiment, canopy panels 182 and/or sidewall panels 186 may be fabricated as a double-walled fabric pocket structure, sized and configured for placement of rigid or semi-rigid panels in the pockets at the site where the structure is erected. Panels comprising wood and wood composites and wood-containing materials, metallic materials, cardboard or paper products, plastics, foam, or the like may be used. In another embodiment, canopy and/or sidewall panels may be provided as inflatable or partially inflatable structures to provide desired rigidity, insulating properties, or the like.

In the embodiment shown in FIG. 17, an external suspension web 194, as previously described, extends externally of the polygonal transition region 192 and supports a peripheral support member 196 having a generally circular configuration. A base suspension web 198, as previously described, may also be optionally provided extending externally of the base of the lower enclosure portion. Fixtures, such as rings, clips, fasteners, grommets, or the like may optionally be provided in connection with the base suspension web for attaching stakes, guy lines, or the like. Clips for attachment of a peripheral base support member having a closed or partially open configuration may also or alternatively be provided in connection with base suspension web 198.

Structures as described herein are typically erected by suspending or supporting an apex of the upper shelter portion. This may be accomplished, for example, by placing one end of at least one internal apical support structure at an apex of the upper shelter portion and placing an opposite end of the one or more internal central support structure(s) on the ground or platform, or by suspending an apical portion of the upper shelter portion using an overhead suspension system. The upper shelter portion is then extended downward and away from the supported apex and one or more peripheral support elements may be mounted in the external suspension web provided at or near the base of the upper shelter portion (and/or at a transition between the upper shelter portion and a lower enclosure portion). Alternatively, one or more peripheral support elements may be mounted and retained in the external suspension web before the central support structure is placed to support the apex of the upper shelter portion. In embodiments in which the upper shelter portion is attached to a lower enclosure portion at a transition seam or joint, a base portion of the lower enclosure portion may then be arranged and anchored, if necessary or desired, to the ground or another stationary structure at several points around its periphery. The structure is preferably erected and anchored so that forces acting at the transition region and/or at the external suspension web are exerted substantially uniformly around the perimeter of the transition region and the external suspension web.

In canopy embodiments employing only an upper shelter portion, an external retaining system and one or more peripheral support elements, the apex of the upper shelter portion may be suspended or supported, as described above, before or after one more peripheral support elements is mounted in an external suspension web. The base of the upper shelter portion is then anchored at multiple points along its periphery to the ground or to a platform or another stationary structure using ropes, wires, or the like to provide tensile forces at the periphery of the upper shelter portion. The structure is preferably erected and anchored so that forces acting at the base of the upper shelter portion and at the external retaining system are exerted substantially uniformly around the perimeter.

Kits for assembling structures of the present invention preferably comprise at least an upper shelter portion having an apex that, when supported by an apical support element, supports structural elements extending peripherally from the apex, and an external suspension web provided on or attachable to a base region of the upper shelter portion. In embodiments in which the structure comprises both an upper shelter portion and a lower enclosure portion, kits of the present invention preferably comprise at least an upper shelter portion having an apex, a lower enclosure portion joined (directly or indirectly) to a base portion of the upper shelter portion at a transition region, and an external suspension web provided at or attachable to the transition region. Kits may additionally comprise one or more apical support elements and one or more peripheral support elements in the form of or assembleable to provide a continuous peripheral support element, such as a circular or partially circular peripheral support element, or a polygonal peripheral support element. Kits may additionally comprise coordinating protective structures such as a canopy or fly, an integral or detachable floor element, anchoring mechanisms such as straps, lines, cords, and stakes, internal shelves and accessories, and the like.

The shelter structures described herein provide many advantages. All elements other than the apical and peripheral support elements may be fabricated from pliable materials that are lightweight, if desired, and easily transported and stored. Pliable fabrics and sheet materials of various types may be used to provide shelter structures suitable for different applications and environments. The shelter structures require minimal rigid components, which may be provided as lightweight collapsible structures. When shelter structures of the present invention are assembled using an internal apical structural support, there is a single structural support member contacting the ground or other support structure, and the rigid components (the internal apical support and the continuous peripheral support element) do not intersect or contact one another, yet they function to stably support the shelter structure and provide a capacious internal volume.

It will be appreciated that the structures, support systems, kits and methods of the present invention may be embodied in a variety of different forms, and that the specific embodiments shown in the figures and described herein are presented with the understanding that the present disclosure is exemplary of the principles of the invention and is not intended to limit the invention to the embodiments, descriptions and illustrations provided herein.

We claim:

1. An assembly that, when assembled, provides a tensioned structure having an internal volume, comprising: a flexible upper shelter portion having an apex and a base peripheral region; a flexible lower shelter portion having an upper region associated with the base peripheral region of the upper shelter portion at a transition region and extending away from the transition region; and an external peripheral suspension web extending externally of the transition region at the interface of the upper shelter portion and a lower shelter portion and having a substantially continuous inner edge associated with the transition region, the external peripheral suspension web being configured for suspending a peripheral support element externally of the transition region, wherein the peripheral support element is suspended only by the external peripheral suspension web.

2. The assembly of claim 1, wherein the external peripheral suspension web comprises a material having different stretch properties than the material(s) forming the upper and lower shelter portions.

3. The assembly of claim 1, wherein the external peripheral suspension web is configured to suspend a peripheral support element having a substantially continuous perimeter and a substantially closed structure form.

4. The assembly of claim 1, wherein the external peripheral suspension web is configured to suspend a continuous peripheral support element having a curved form extending externally along at least 50% of the perimeter of the transition region.

5. The assembly of claim 1, wherein the transition region has a circular or polygonal configuration and the external peripheral suspension web is configured to suspend a peripheral support element having a generally circular configuration.

6. The assembly of claim 1, wherein the external peripheral suspension web is configured to suspend a peripheral support element on a plane substantially parallel to a plane of a ground or support surface when the assembly is assembled to provide a tensioned structure.

7. The assembly of claim 1, wherein the apex is at a central location of the upper shelter portion.

8. The assembly of claim 1, wherein the apex is not at a central location of the upper shelter portion and either or both the upper and lower shelter portions are asymmetrically arranged with respect to the apex.

9. The assembly of claim 1, additionally comprising a floor associated with a base peripheral region of the lower shelter portion.

10. The assembly of claim 1, additionally comprising an eave associated with the structure and positioned below the transition region, wherein the eave is formed as a band having a cylindrical or annular configuration.

11. The assembly of claim 10, wherein the eave is fabricated from a material that is different from the material used for the upper and/or lower shelter portions.

12. The assembly of claim 1, additionally comprising an internal central apical support structure and an internally directed tensioning structure extending internally of the transition region and configured to be suspended between the transition region of the assembly and the internal apical support structure and adjustably positioned in association with the central apical support structure when the assembly is assembled as a tensioned structure.

13. The assembly of claim 12, wherein the internally directed tensioning structure comprises a plurality of radially arranged webs or a substantially continuous fabric structure.

14. The assembly of claim 1, additionally comprising a plurality of pliable external buttressing elements positioned below the external suspension web and physically linking the external suspension web and the lower shelter structure.

15. The assembly of claim 1, additionally comprising a plurality of internal buttressing elements positioned to physically link internal surfaces of the upper and lower shelter portions in the area of the transition region.

16. The assembly of claim 1, wherein the flexible upper and lower shelter portions comprise a pliable fabric material.

17. A tensioned fabric structure comprising: a flexible upper shelter portion having an apex supported by an apical support structure and a base peripheral region; a flexible lower shelter portion having an upper region associated with the base peripheral region of the upper shelter portion at a transition region and extending away from the transition region and the base peripheral region of the upper shelter portion; and an external peripheral suspension web extending externally of the transition region and having a substantially continuous inner edge associated with the transition region supporting a peripheral support element externally of the transition region along at least 50% of the perimeter of the transition region, wherein the peripheral support element is suspended only by the external peripheral suspension web.

18. The tensioned fabric structure of claim 17, wherein the peripheral support element has a substantially continuous perimeter and a substantially closed structure form.

19. The tensioned fabric structure of claim 17, wherein the peripheral support element has a generally circular configuration.

20. The tensioned fabric structure of claim 17, wherein the peripheral support element is suspended on a plane substantially parallel to a ground plane or a support surface plane.

21. The tensioned fabric structure of claim 17, additionally comprising a base suspension web extending externally of a base region of the lower shelter portion and a plurality of fixtures associated with the base suspension web and positioned a distance externally of the base region of the lower shelter portion.

22. The tensioned fabric structure of claim 21, wherein the base suspension web has a substantially continuous inner edge associated with the base region of the lower shelter portion.

23. The tensioned fabric structure of claim 17, wherein the apex of the upper shelter portion is supported by at least one internal apical support.

24. The tensioned fabric structure of claim 17, additionally comprising a second external peripheral suspension web supporting a second peripheral support element externally of the fabric structure.

25. A kit for assembling a tensioned fabric structure comprising: a flexible upper shelter portion having an apex and a base peripheral region; a flexible lower shelter portion having an upper region associated with the base peripheral region of the upper shelter portion at a transition region and extending away from the transition region; an external peripheral suspension web having a substantially continuous inner edge associated with the transition region extending externally of the transition region and configured for supporting a peripheral support element externally of the transition region; and a peripheral support element having, or assemble-able to have, a continuous form and adapted to be suspended solely by the external suspension web.

26. The kit of claim 25, wherein the peripheral support element has, or assemble-able to have, a closed, continuous form.

27. The kit of claim 26, wherein the peripheral support element is assemble-able to form a closed, continuous form by joining a plurality of tubular sections to one another at interlocking ends.

28. The kit of claim 25, additionally comprising a second external suspension web associated with and extending externally of a perimeter of the lower shelter portion and configured for supporting a peripheral support element externally of the lower shelter portion.

29. The kit of claim 25, additionally comprising at least one internal apical support element.

30. The kit of claim 25, additionally comprising a covering structure adapted to be suspended over the tensioned fabric structure.

* * * * *